US006565252B2

(12) United States Patent
Dillinger et al.

(10) Patent No.: US 6,565,252 B2
(45) Date of Patent: May 20, 2003

(54) APPARATUS FOR AUTOMATED FINISHING OF INTERIOR SURFACES

(75) Inventors: Daniel Dea Dillinger, Parsons, KS (US); John Ed O'Mara, Wichita, KS (US)

(73) Assignee: Renegade Tool Company, Parsons, KS (US)

( * ) Notice: Subject to any disclaimer, the term of this patent is extended or adjusted under 35 U.S.C. 154(b) by 0 days.

(21) Appl. No.: 09/760,223

(22) Filed: Jan. 12, 2001

(65) Prior Publication Data

US 2002/0093876 A1 Jul. 18, 2002

(51) Int. Cl.[7] ..... B28C 5/08
(52) U.S. Cl. ..... 366/13; 366/64
(58) Field of Search ..... 366/13, 64, 42, 366/46, 48, 51, 53, 54, 55, 56, 62, 38, 27, 28, 194, 319, 321, 349

(56) References Cited

U.S. PATENT DOCUMENTS

| | | | | | |
|---|---|---|---|---|---|
| 2,131,681 | A | * | 9/1938 | Ball | 366/51 |
| 2,633,340 | A | * | 3/1953 | Zagray et al. | 366/51 |
| 2,741,220 | A | | 4/1956 | Belisle | 118/405 |
| 2,815,142 | A | | 12/1957 | Ames | 216/25 |
| 2,828,112 | A | * | 3/1958 | Kammer | 366/194 |
| 2,880,976 | A | * | 4/1959 | True | 366/13 |
| 3,011,414 | A | * | 12/1961 | Stein | 366/53 |
| 3,017,164 | A | * | 1/1962 | Ayers et al. | 366/13 |
| 3,043,571 | A | * | 7/1962 | Swarthout | 366/46 |
| 3,137,482 | A | * | 6/1964 | Hackley | 366/13 |
| 3,203,631 | A | * | 8/1965 | Jutila | 366/194 |
| 3,260,638 | A | | 7/1966 | Hoveland | 156/575 |
| 3,576,091 | A | | 4/1971 | Shull, Jr. | 52/309 |
| 3,707,427 | A | | 12/1972 | Erickson | |
| 3,807,706 | A | * | 4/1974 | Kugle et al. | 366/51 |
| 3,880,701 | A | | 4/1975 | Moree | 156/526 |
| 3,938,786 | A | * | 2/1976 | Bernold | 366/13 |
| 4,105,490 | A | | 8/1978 | Lass | 156/526 |
| 4,147,331 | A | * | 4/1979 | Kopecky | 366/46 |
| 4,208,239 | A | | 6/1980 | Lass | 156/575 |
| 4,309,238 | A | | 1/1982 | Hauk | 156/575 |
| 4,311,274 | A | * | 1/1982 | Neal | |
| 4,469,342 | A | | 9/1984 | Millard | 280/148 |
| 4,587,886 | A | | 5/1986 | Masuda | 91/415 |
| 4,642,158 | A | | 2/1987 | Stinel | 156/497 |
| 4,652,331 | A | | 3/1987 | Plasencia | 156/526 |
| 4,689,107 | A | | 8/1987 | Entwistle | 156/465 |
| 4,707,202 | A | | 11/1987 | Sweeny | 156/71 |
| 4,775,442 | A | | 10/1988 | Januska | 156/575 |
| 4,828,647 | A | | 5/1989 | Eccleston | 156/526 |
| 4,941,132 | A | * | 7/1990 | Horn et al. | |
| 5,013,389 | A | | 5/1991 | Retti | 156/526 |
| 5,137,366 | A | * | 8/1992 | Hill et al. | |
| 5,230,608 | A | | 7/1993 | Januska | |
| 5,242,495 | A | | 9/1993 | Hammond | 118/43 |
| 5,352,035 | A | * | 10/1994 | Macaulay et al. | 366/321 |
| 5,727,876 | A | * | 3/1998 | Tynan | |
| 5,902,451 | A | | 5/1999 | O'Mara et al. | |
| 6,053,365 | A | | 4/2000 | O'Mara et al. | |

OTHER PUBLICATIONS

U.S. patent application Ser. No. 09/760,225 filed Jan. 12, 2000.

* cited by examiner

*Primary Examiner*—Tony G. Soohoo
(74) *Attorney, Agent, or Firm*—Bracewell & Patterson, L.L.P.

(57) ABSTRACT

An automated interior finishing apparatus has an upper section for mixing material, and a lower section for conveying the material. The upper section has a mixing compartment and a separate washing/storage compartment. Each compartment has a hinged lid that forms an air-tight seal. The mixing compartment has a shaft with an auger for mixing compound with water. The lower section has a motor for driving a progressive cavity pump, which receives mixed material from the mixing compartment. The pump delivers a smooth and uniform supply of material through an external supply hose. The apparatus is used as one component of an overall automated interior finishing system and method for completing surface finishes. For example, one end of the supply hose is connected to the outlet end of the pump for delivering mixed material to a hand tool at the opposite end, such as a flat taper.

35 Claims, 17 Drawing Sheets

APPARATUS FOR AUTOMATED FINISHING OF INTERIOR SURFACES

BACKGROUND OF THE INVENTION

1. Technical Field

The present invention relates in general to improved interior surface finishing, and in particular to an automated apparatus for finishing interior surfaces such as drywall, acoustic, and painted surfaces.

2. Description of the Prior Art

Wallboard or drywall has become the dominant material in the production of interior building partitions. Interior building partitions typically comprise a studwall of vertical support members or studs that are spaced apart from each other in a parallel arrangement. The studs are used to support preformed panels or wallboards that are usually attached to the studwall with fasteners. A joint exists between adjacent ones of the the abutted wallboards.

In order to provide a continuous flat surface appearance to the wall, it is necessary to apply a finish to the joint between the adjacent panels. Finishing typically requires the build-up of multiple layers of a mastic material or joint compound that is commonly referred to as mud. Mud is a paste-like substance that is formed by mixing a powdery compound with water. The blending of the joint compound into the panel surface forms the desired flat and contiguous wall surface. The build-up of mud in the joint area or "floating" comprises the application of a first layer of mud and the embedding of a wallboard tape such as paper or fiberglass tape in the first layer. Finally, one or two more layers of mud are applied on top of the first layer/tape to complete the joint. The finishing of the joints is a time consuming and labor intensive process, since it is generally necessary to wait 24 hours between each application of mud in order to allow each layer to dry. In addition, it is generally necessary to sand the joint area so as to produce a finish that matches the remainder of the wallboards.

It is convenient to use a container for the mud which may or may not include means for supporting a roll of tape. Combination mud and tape devices guide the tape through the mud and dispense it from the container at the desired length with the tape coated in the mud. A number of devices have been devised in attempts to more efficiently and effectively dispense mud during the drywalling process. Some devices are pressurized to dispense the mud, while others require traditional manual application. Unfortunately, most prior art designs have not been fully accepted by the construction trade. In particular, air pressurized systems have been marginal at best as there is significant time lag during dispensing, and a potentially uneven application.

The application of drywall mud can also require large pieces of equipment including a mud tank that is hauled on trucks to the work site. The equipment is routinely left outside the structure being drywalled. After each day's use, the equipment, particularly the mud tank, must be cleaned with pressurized water. This operation usually involves another piece of equipment.

Accordingly, a need exists for an automated apparatus for interior finishing, such as a drywall compound feeding device, that provides a steady and closely controlled flow rate of mixed material through an application fixture. Another need exists for an automated, positive displacement device, such as a mud feeding device, that has negligible hesitation or lag time between the initial release of material through the applicator and the time at which the material reaches its steady state flow rate. In addition, a need exists for a finishing apparatus that does not require clean-up of the apparatus and tools, and which is less cumbersome and more portable.

SUMMARY OF THE INVENTION

One embodiment of an automated device for finishing interiors utilizes an apparatus having an upper section for material mixing purposes, and a lower section for material conveying purposes. The upper section has a large basin with a mixing compartment and a separate washing/tool storage compartment. Each compartment has a hinged lid that forms an air-tight seal. The storage compartment has a hose with a spray nozzle for dispensing a pressurized spray of water. The mixing compartment has a mixer shaft with a modified ribbon auger for mixing compound with water dispensed from jets located in the mixing compartment. The lower section of the apparatus contains a motor for driving a progressive cavity pump, which receives mixed material from the mixing compartment. A pair of water pumps are also mounted to the lower section and provide pressurized water to the upper compartments from a water tank. The pump delivers a smooth and uniform supply of material through an external supply hose.

The apparatus is used as one component of an overall automated interior finishing system and method for completing surface finishes. For example, one end of the supply hose is connected to the outlet end of the pump for delivering mixed material to a hand tool at the opposite end, such as a flat taper. Many other combinations of tools and components are possible for finishing surfaces, depending upon the particular application required. In another embodiment, the automated interior finish apparatus has two pumping systems that allow two operators to simultaneously use the device. In yet another embodiment, the automated interior finish apparatus has a single compartment for mixing, clean-up, and tool storage. Each of these versions is capable of being partially disassembled or broken down into two separate, lighter pieces with four easy steps.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT OF THE PRESENT INVENTION

Figure 1:
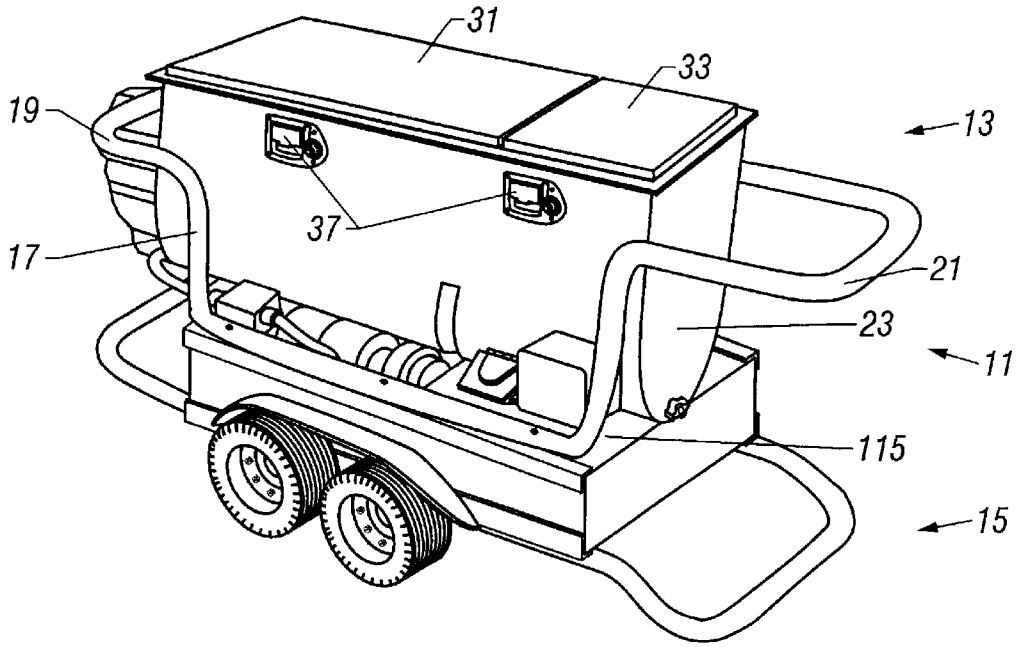
FIG. 1 is an isometric view of one embodiment of an automated interior finishing apparatus constructed in accordance with the present invention.
Figure 15:
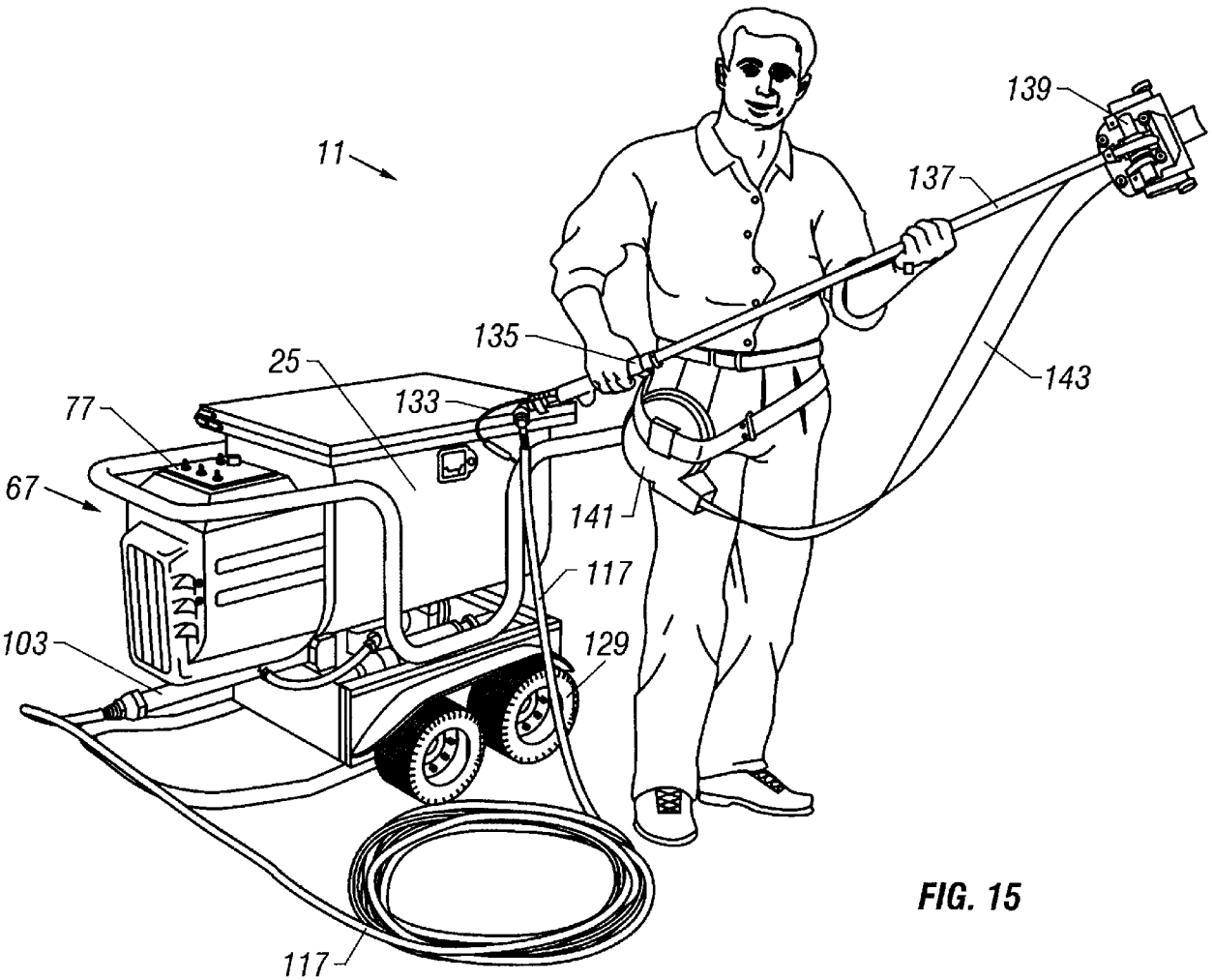
FIG. 15 is an isometric view of the apparatus of FIG. 1 in operation.

Referring to FIG. 1, one embodiment of an automated interior finishing base unit or apparatus 11 constructed in accordance with the present invention is shown. Apparatus 11 is one component of an overall automated interior finishing system and method for completing surface finishes. For example, one combination of the tools and components of the automated interior finishing system and method is shown in FIG. 15. One skilled in the art will recognize that many other combinations of tools and components are possible for finishing surfaces, depending upon the particular application required.

Figure 3:
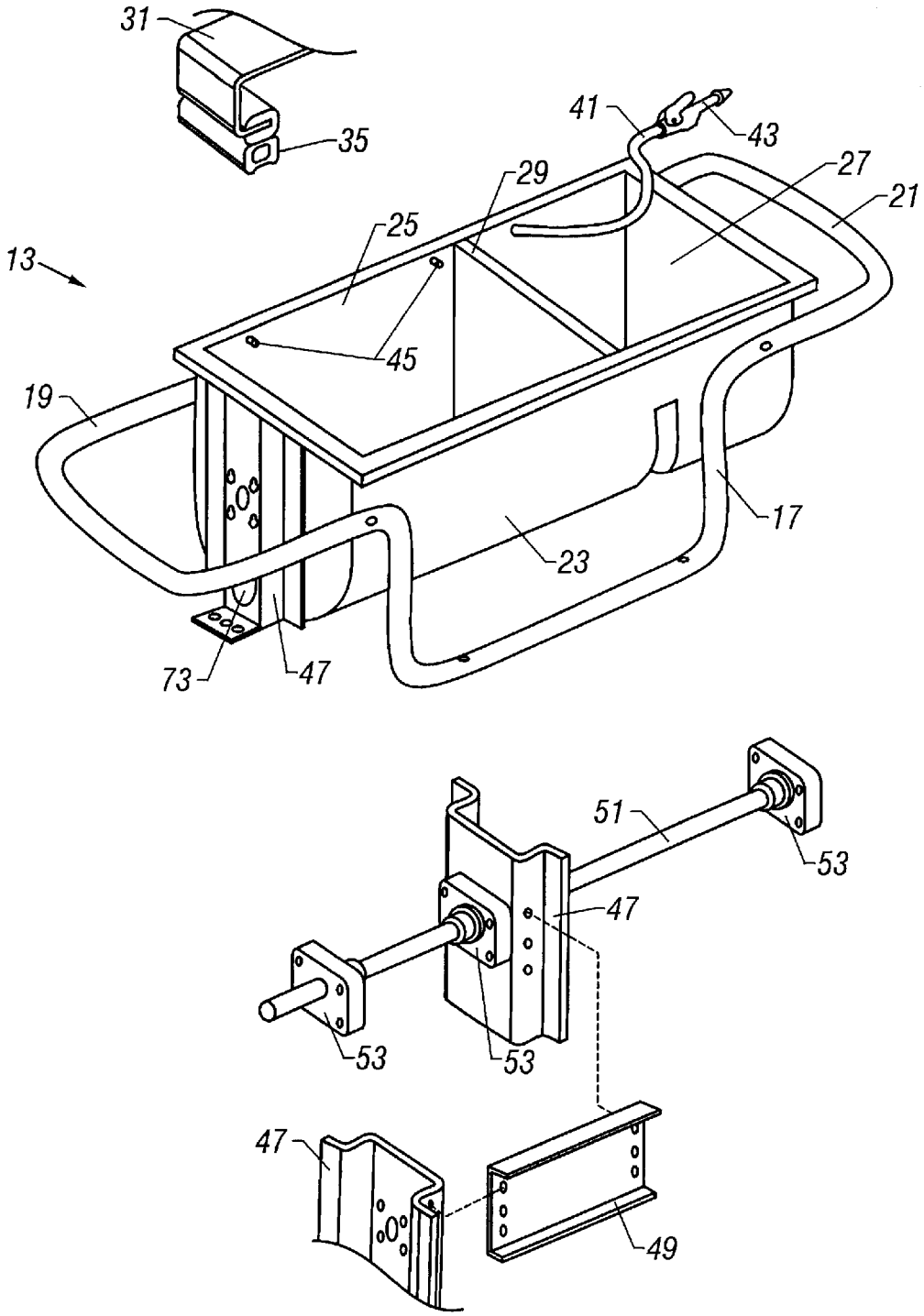
FIG. 3 is an exploded isometric view of an upper portion of the apparatus of FIG. 1.

In the version shown, apparatus 11 may generally be described as having an upper section 13 for material mixing purposes, and a lower section 15 for material conveying purposes. Upper section 13 has a rigid tubular mounting frame 17 that is preferably formed from schedule-40 stainless steel tubing having an outer diameter of one inch. Frame 17 has handles 19, 21 that extend beyond each end of a large trough or basin 23 to provide multiple pick-up points for apparatus 11. As shown in FIG. 3, basin 23 is mounted to frame 17 and divided into two chambers or compartments: a large automated mixing compartment 25, and a smaller wash and tool storage compartment 27. A dividing wall 29 is located in basin 23 between compartments 25, 27.

Figure 2:
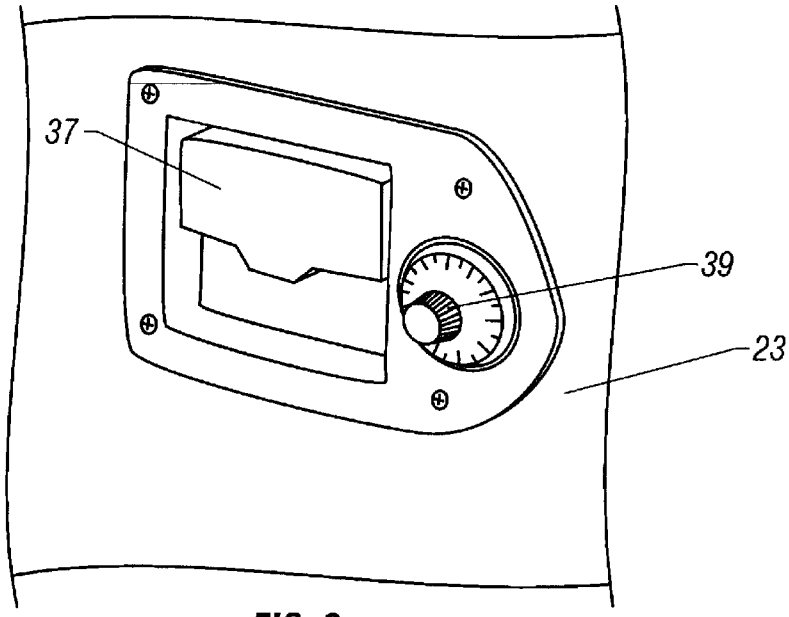
FIG. 2 is a side view of a locking handle on the apparatus of FIG. 1.

Each compartment 25, 27 is provided with an independent cover or lid, 31, 33 (FIG. 1), respectively. Each lid 31, 33 is pivotally mounted near the upper edge of basin 23 with a hinge. The perimeter of the inner surface of each lid 31, 33 is provided with a gasket 35 (FIGS. 3 and 10), such as a hollow bulb seal. Gaskets 35 allow lids 31, 33 to form independent, air-tight seals with their respective compartments 25, 27 at the upper planar surfaces of basin 23 and wall 29, which are substantially flush with each other. As illustrated in FIG. 2, each compartment 25, 27 has a latching mechanism 37 on an exterior of basin 23, including a combination or key lock 39, for selectively locking and controlling access thereto, and for providing tool protection. In addition, the mixing compartment 25 is automatically electrically interlocked for operator safety via the control panel, which will be described in greater detail below.

Figure 14:
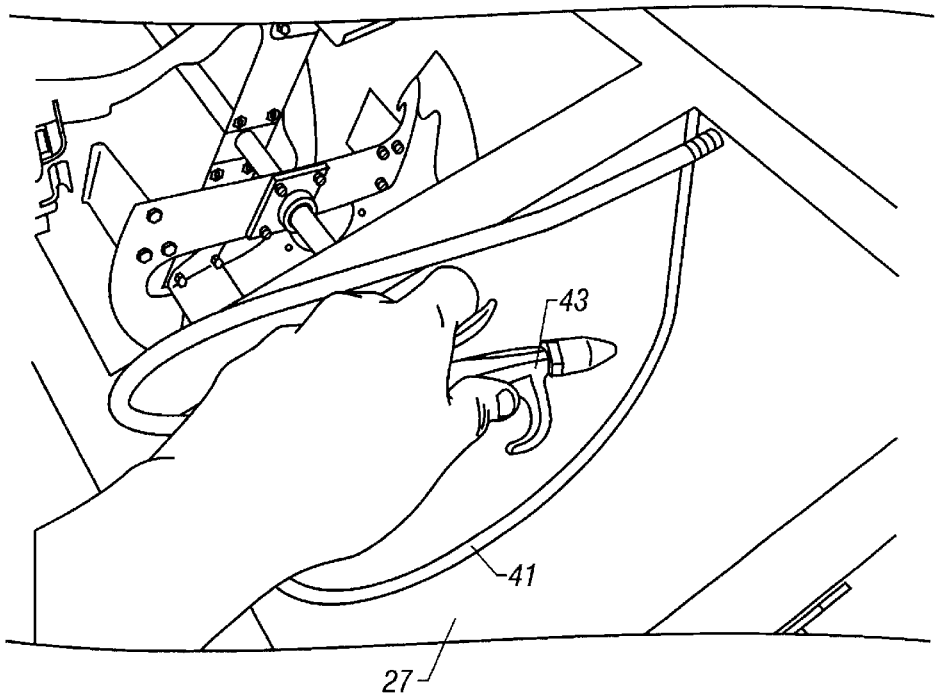
FIG. 14 is a reverse isometric view of the upper portion of the apparatus of FIG. 1 illustrating usage of a wash basin.

Referring to FIGS. 3 and 14, storage compartment 27 is equipped with a small diameter hose 41 having a spray nozzle 43 for dispensing a pressurized spray of water. Nozzle 43 has fingertip controls for adjusting both the flow rate and the spray pattern of the water. Hose 41 and nozzle 43 provide on-board tool clean-up in storage compartment 27. When storage compartment 27 is not being used for clean-up, it provides an additional air-tight tank for tool storage in apparatus 11. Thus, if preferred by the user or operator, the tools need not be cleaned up after each use, but can be stored within the moisture-proof basin 23 until their next use since the wet material remaining in the tools stays compliant and will not dry out.

Mixing compartment 25 has a pair of nozzles or jets 45 for adding water thereto. In the version shown, jets 45 are located on opposite ends of compartment 25 and only control the flow rate of the water dispensed therein. Jets 45 allow water to be manually or automatically added to the material in mixing compartment 25 and reduce viscosity. A hose-to-tank connection provides simultaneous compound mixing and circulation.

Figure 4A:
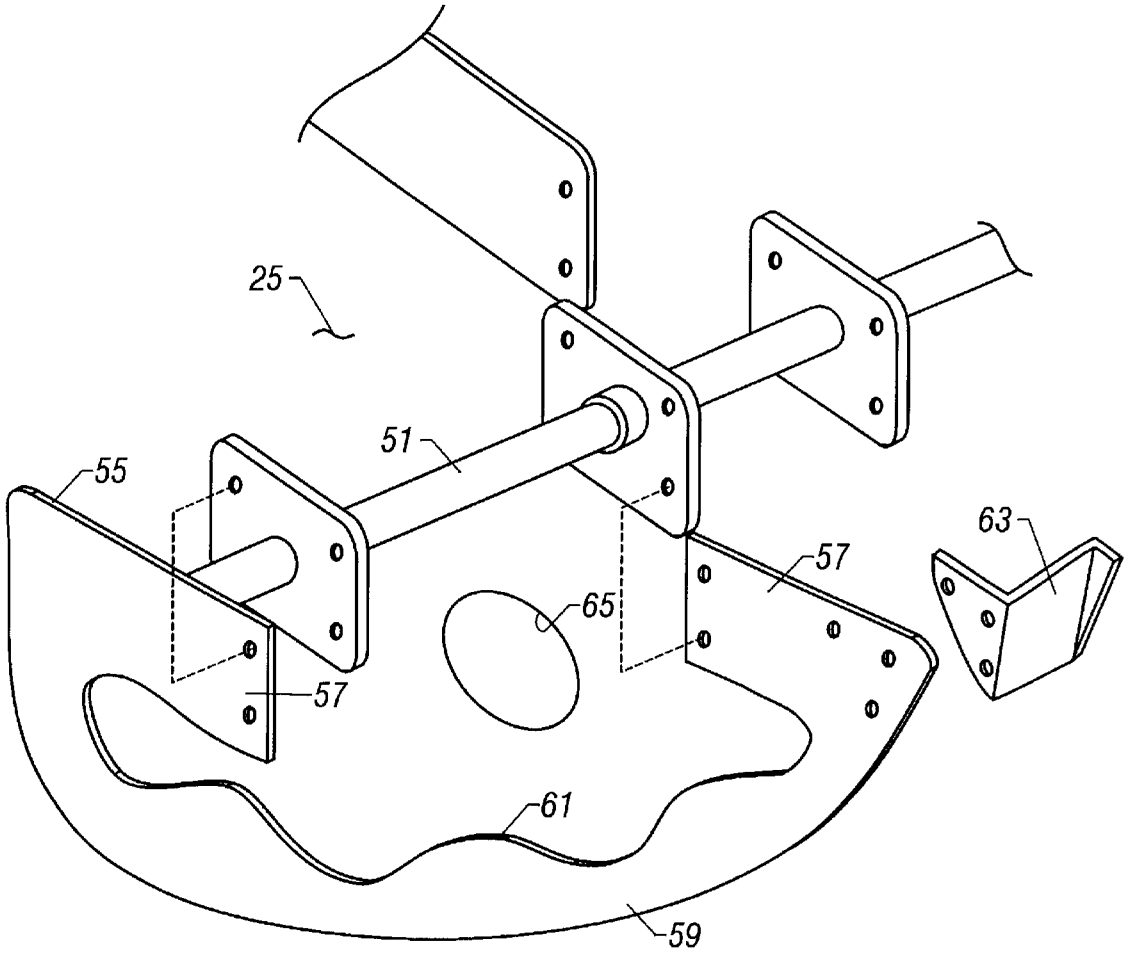
FIG. 4*a* is an exploded isometric view of a mixing assembly of the apparatus of FIG. 1.

In addition to frame 17, a series of support members or channels 47, 49 are also used for the structural support of apparatus 11. In particular, channels 47 help support a mixer shaft 51 that extends through and is sealed to mixing compartment 25 on bearings 53. As shown in FIG. 4*a*, a pair of generally helical, modified ribbon mixers or augers 55 are rigidly mounted to mixer shaft 51 for rotation therewith.

Figure 12:
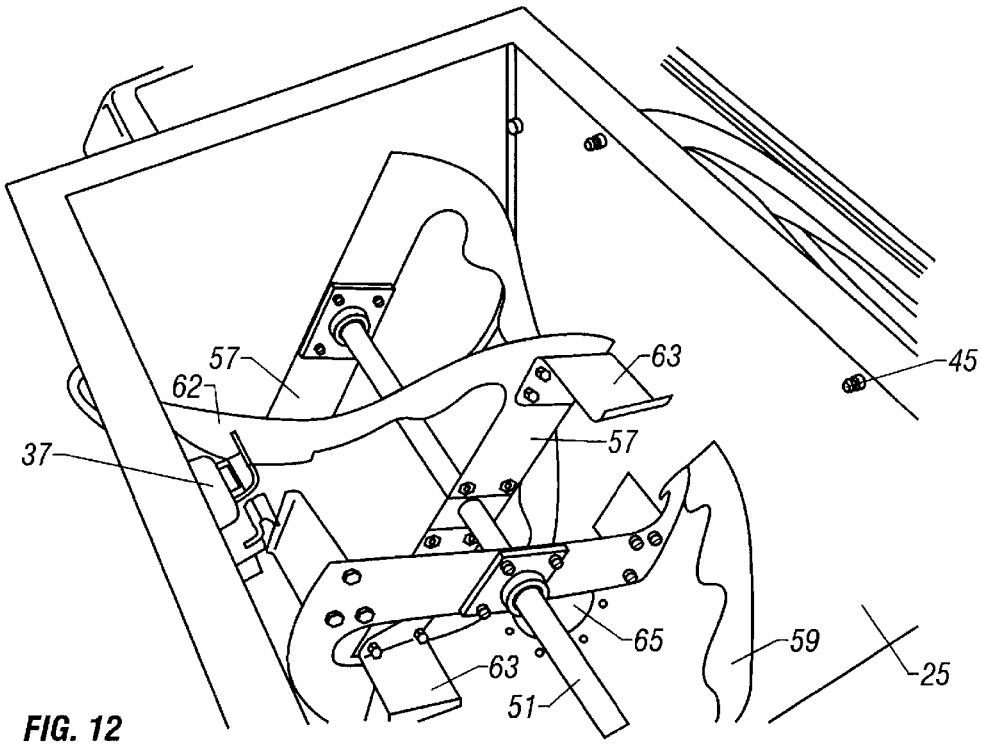
FIG. 12 is a reverse isometric view of the upper portion of the apparatus of FIG. 1 with the lids in the open position.

Each auger 55 has a pair of mounting elements 57 with a fluted blade 59 extending therebetween as shown. In the preferred embodiment, blades 59 have a series of sculptured edges 61 with one-half inch radii that significantly contribute to the mixing process. Each auger 55 also has a smooth-edged flat blade 62 (FIG. 12) joining axially adjacent ones of the mounting elements 57 for greater structural strength while mixing.

Figure 4B:
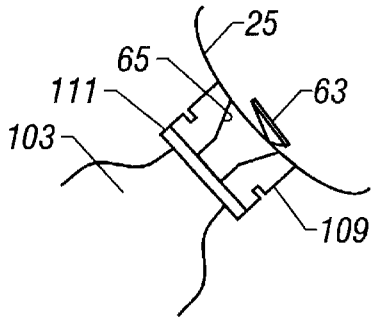
FIG. 4*b* is a sectional end view of the apparatus of FIG. 1.

Each blade 59 also has a force plate 63 mounted thereto. Force plates 63 are generally tangentially oriented relative to the inner surface of mixing compartment 25, but skewed slightly in two directions, thereby causing a higher downward force on the material. As illustrated in FIG. 4*b,* force plates 63 assist in feeding and forcing material into a tank opening 65 in mixing compartment 25, and keeping the pump intake fully charged with material. This system also will remove most of the material from the tank, leaving very little to clean up at the end of an application. Ideally, tank opening 65 is located at the bottom of the axial center of mixing compartment 25 (see FIG. 12) so that both force plates 63 centrally align therewith. Together, blades 59 and force plates 63 keep the material, such as drywall, acoustic, or paint compounds, in a uniform consistency, and material is delivered to the tools in a smooth, regulated flow. The center feed allows augers 55 to be rotationally reversed, which keeps the material from being overly forced into the pump. The reversible augers 55 blend the material more efficiently because there is a shear point between the augers and the ends of the tank. Preferably, the material is blended before it leaves mixing compartment 25 in order to prevent pump jamming. Rotating augers 55 in only one direction may result in unblended material entering the pump, which can block the pump intake and stop the flow.

Figure 7:
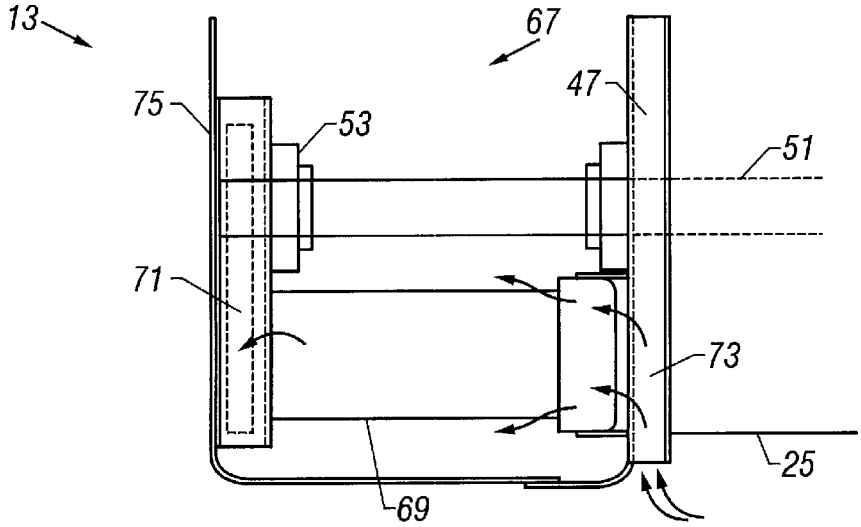
FIG. 7 is a sectional side view of an end of the lower portion of the apparatus of FIG. 1.

Referring now to FIG. 7, mixer shaft 51 extends through one end of mixing compartment 25 into a shroud or console 67 where mixer shaft 51 is mounted to channel 47 via bearings 53. The distal end of mixer shaft 51 is coupled to a mixer drive motor 69 via drive mechanism 71 such as a timing belt. Channel 47 has an air inlet 73 (see FIG. 3) that allows mixer drive motor 69 to cool the electrical components in console 67 as indicated by the arrows. Air flow exits through vents 75 at the back of console 67. This feature eliminates the need for an additional cooling fan. The dual bearing support uses the mixer shaft 51 as part of the motor support structure.

Figure 8:
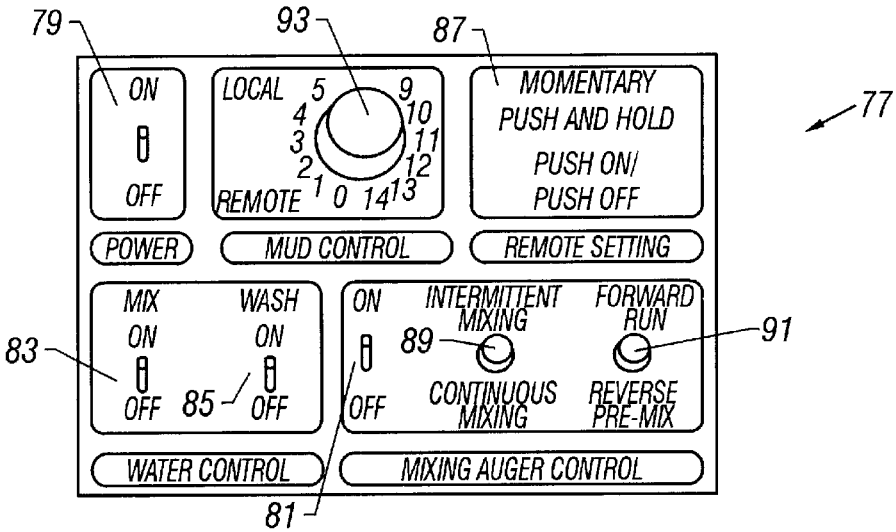
FIG. 8 is a plan view of a control panel utilized by the apparatus of FIG. 1.
Figure 9:
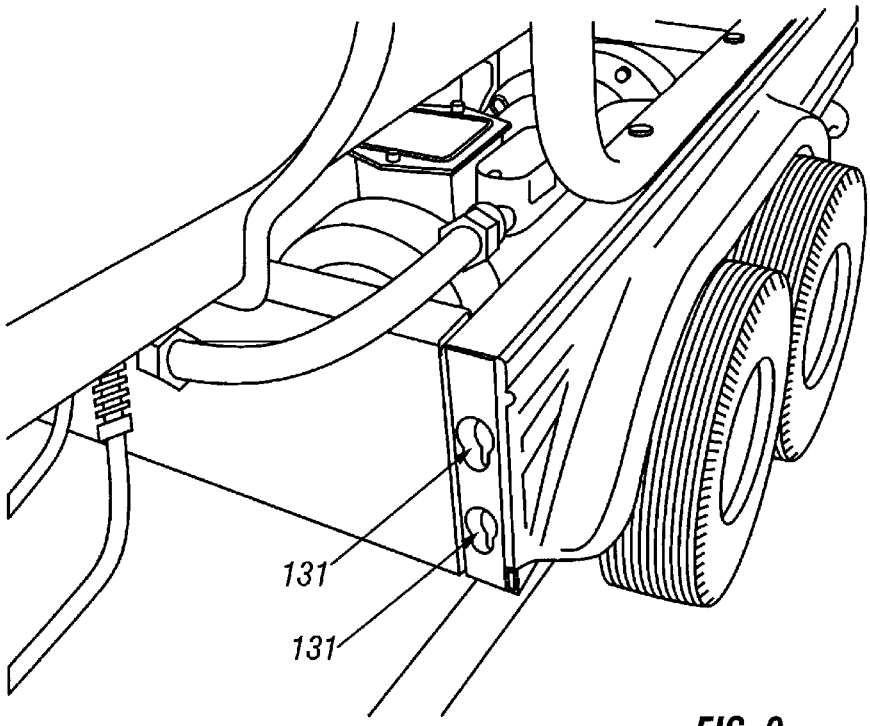
FIG. 9 is an isometric view of an end of the lower portion of the apparatus of FIG. 1 with handles retracted.
Figure 10:
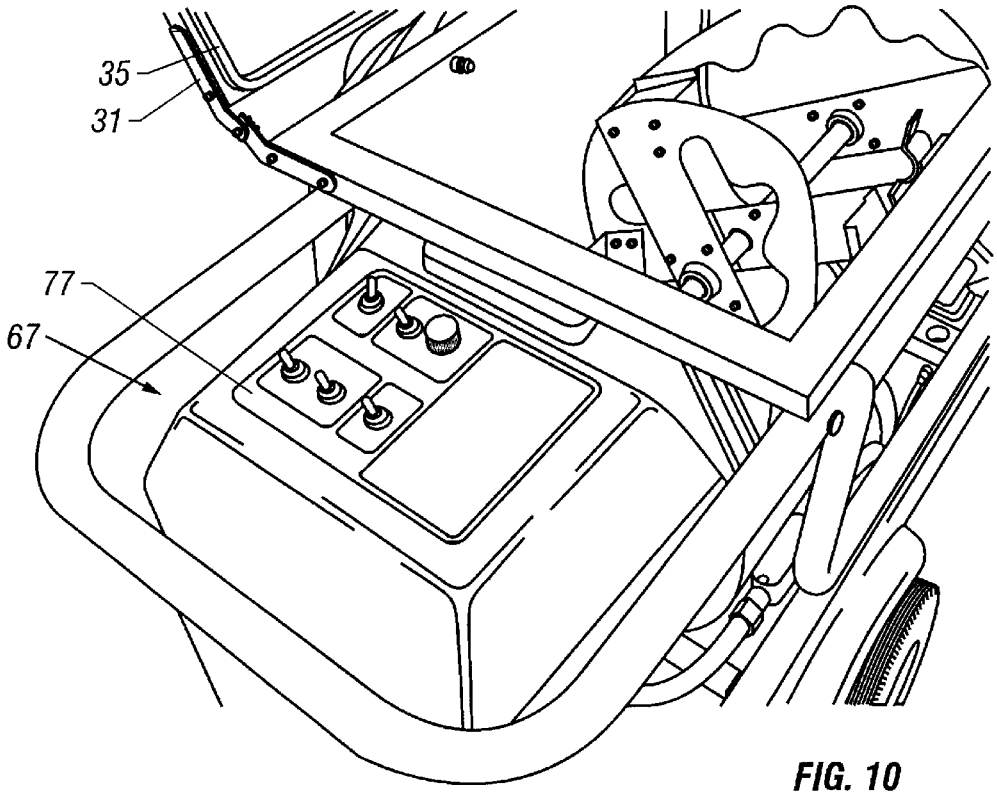
FIG. 10 is an isometric view of an end of the upper portion of the apparatus of FIG. 1 with the lids in an open position.

As shown in FIGS. 8 and 10, a control panel 77 for apparatus 11 is located at the upper end of console 67. Control panel 77 provides a convenient, centralized location for operator ease and material control. Control panel 77 includes a main power switch 79 for the entire apparatus 11, and a mixer power switch 81 for actuating augers 55. A pair of water control switches 83, 85 control water flow to compartments 25, 27 (e.g., jets 45 and nozzle 43, respectively). Material control switch 93 allows the operator to control continuous flow from either apparatus 11 (local) or a handheld tool (remote). A remote setting switch 87 allows an operator to change a control handle switch from a manual or momentary operation where the control handle switch must be depressed to allow material to flow. Instead, remote setting switch 87 allows the operator to push the button once for on and once again to interrupt flow without the need to continuously depress a switch, thereby relieving finger strain.

In the preferred embodiment, switch 81 is used to change the control at the handheld tool from manual to automatic control. In the automatic control position, a sensor at the tool sends an electrical frequency to a signal conditioner. The signal conditioner changes the frequency to a linear voltage that causes the DC pump drive motor 101 (FIG. 5) to rotate at a speed proportional to the frequency generated. This means that the faster or slower the hand tool is used, that the frequency change will alter the pump speed, thereby making the pump 103 a metering device that is capable of delivering the correct amount of material to the application tool at all times. The system is backed up with a manual control system that is operable in the event that the automatic controls become damaged.

There are many ways to generate these frequencies. Preferably, an inductive proximity switch sends a pulse to the signal conditioner each time a gear tooth on the application tool comes in close proximity to the sensor. Other devices and methods for achieving this function include encoders, hall effect sensors, mechanical switches, and optical sensors. In addition, there are many types of signal conditioners such as microprocessor-based conditioners. However, a cut-off switch that is activated at the end of a drywall tape run, or a non-microprocessor-based signal conditioner that follows the input without an extended processing time after the input is terminated is preferred.

In addition, control panel 77 provides intermittent rotation of the augers via switch 89 so that mixing only occurs when the pump is in operation. After a pre-mixing of the material is complete via switch 91, this feature prevents the material from being over-mixed, which would be the case if it was allowed to be continuously mixed. Thus, once the pre-mix is complete, apparatus 11 can be switched to intermittent where the augers are used to only charge the pump. Furthermore, all electrical components are moisture-sealed in the non-conductive, durable console 67. External re-settable fuses add safety and convenience. Note that console 67 and control panel 77 are surrounded and protected by handle 19 of frame 17.

Figure 5:
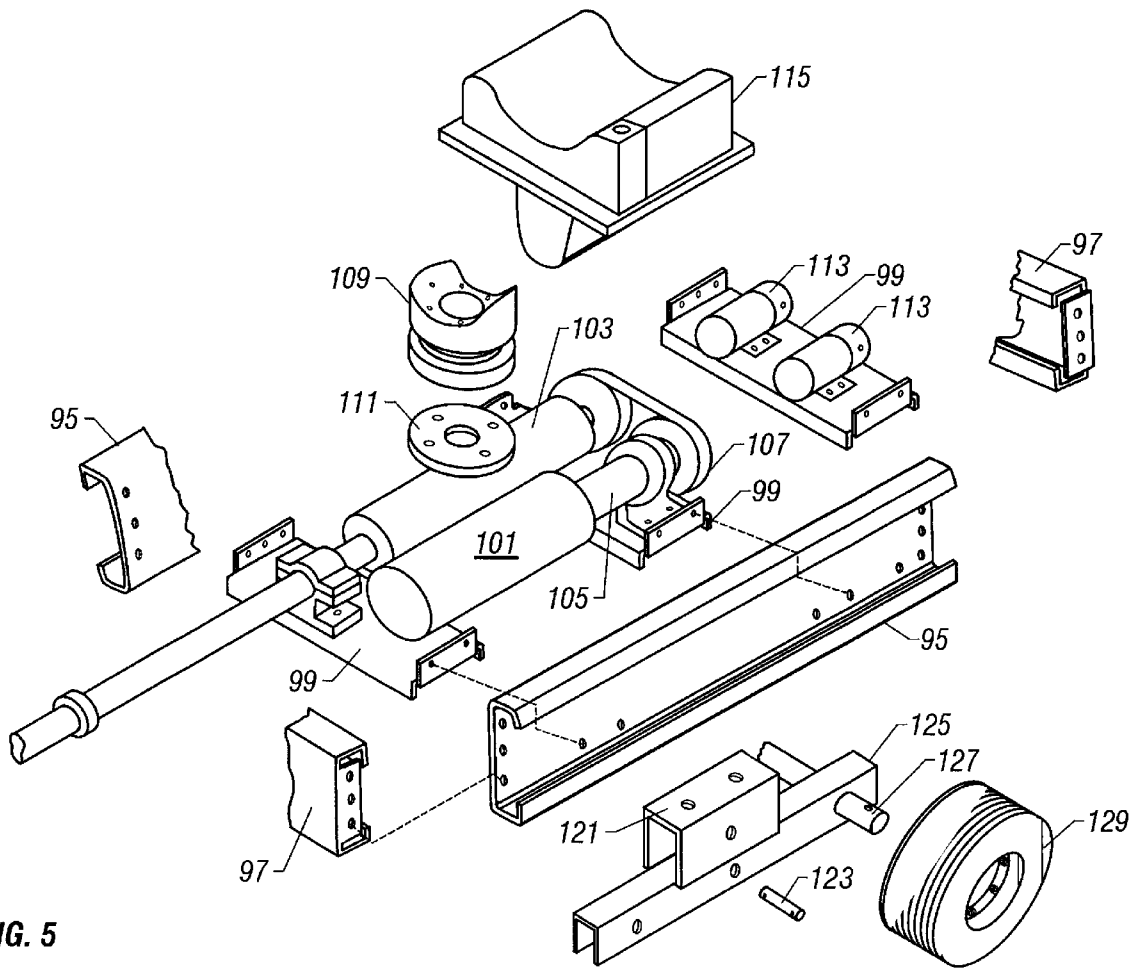
FIG. 5 is an exploded isometric view of a lower portion of the apparatus of FIG. 1.

Referring now to FIG. 5, an exploded view of the lower section 13 of apparatus 11 is shown. The components of lower section 13 mount to a pair of side channels 95 that are joined via end channels 97 and other mounting channels 99. In the preferred embodiment of apparatus 11, a single motor 101 drives a progressive cavity pump 103 via a gearbox 105 and timing belt drive 107, which are mounted to channels 99. An intake fitting 109 is mounted between pump intake 111 and the lower end of tank opening 65 (FIG. 4*b*) for receiving material into pump 103. A screen is located between the pump and compartment 25 to catch any debris that may fall into the tank. A pair of water pumps 113 are also mounted to one of the channels 99 for providing pressurized water to compartments 25, 27 from a water tank 115 which locates between basin 23 and water pumps 113. In combination, water pumps 113, water tank 115, nozzle 43, and jets 45 provide a complete on-board water system for the uses previously described.

Figure 6:
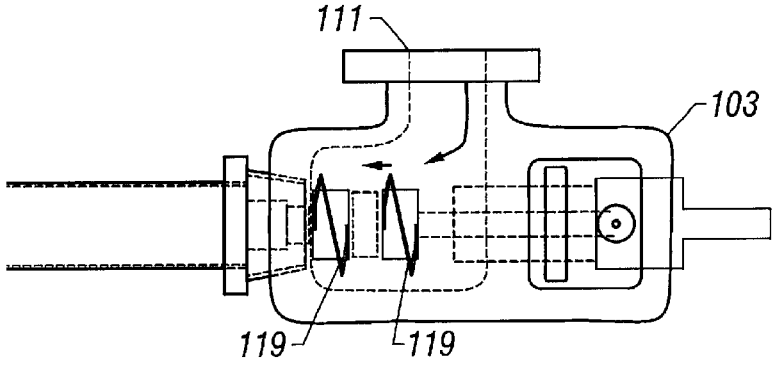
FIG. 6 is a sectional side view of a portion of a pump utilized in the apparatus of FIG. 1.
Figure 13A:
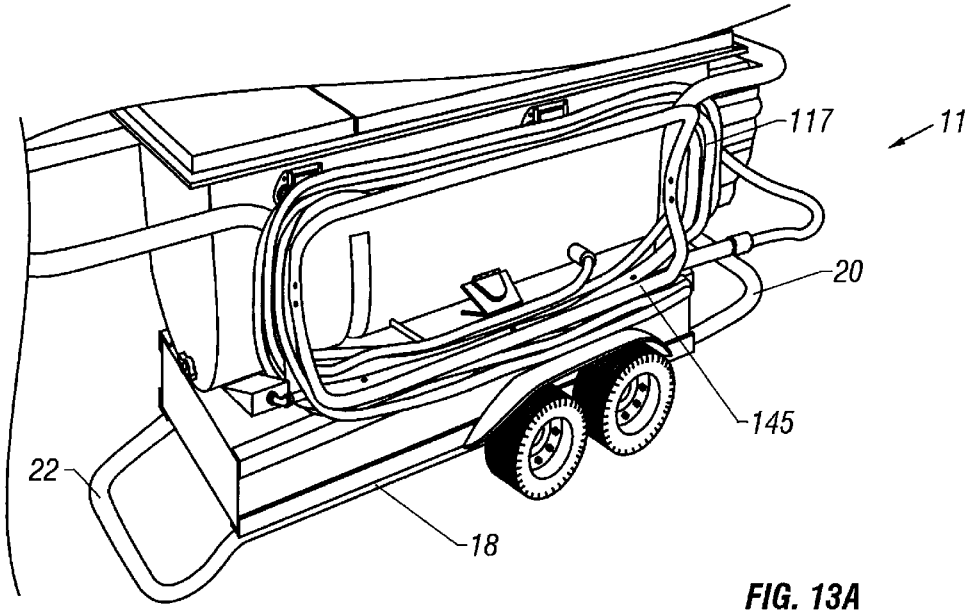
FIG. 13*a* is an opposite isometric view of the apparatus of FIG. 1.

The positive displacement pump 103 has a variable speed drive that ensures a smooth and uniform supply of mixed material through an external supply conduit or hose (FIG. 13*a*). The delivery or flow of material through pump 103 is significantly enhanced by a pair of helical or fan-type rotor agitators 119 (FIG. 6) that reduce jamming and provide debris-free, positive delivery of all types of compounds. In contrast, conventional pumps utilize simple pin retainer bushings that jam when, for example, an operator fails to fill the pump with water prior to adding compound. Without agitators 119, the un-mixed compound would be forced into pump 103 with force plates 63 and would not create enough suction to start the un-mixed compound into the progressive pump chambers.

Figure 11:
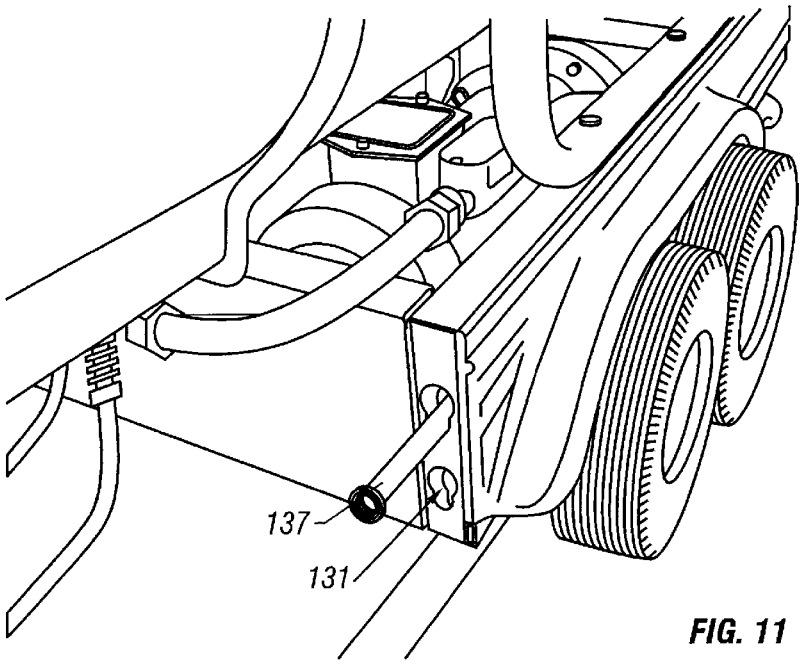
FIG. 11 is an isometric view of an end of the lower portion of the apparatus of FIG. 1 with handles extended.
Figure 16:
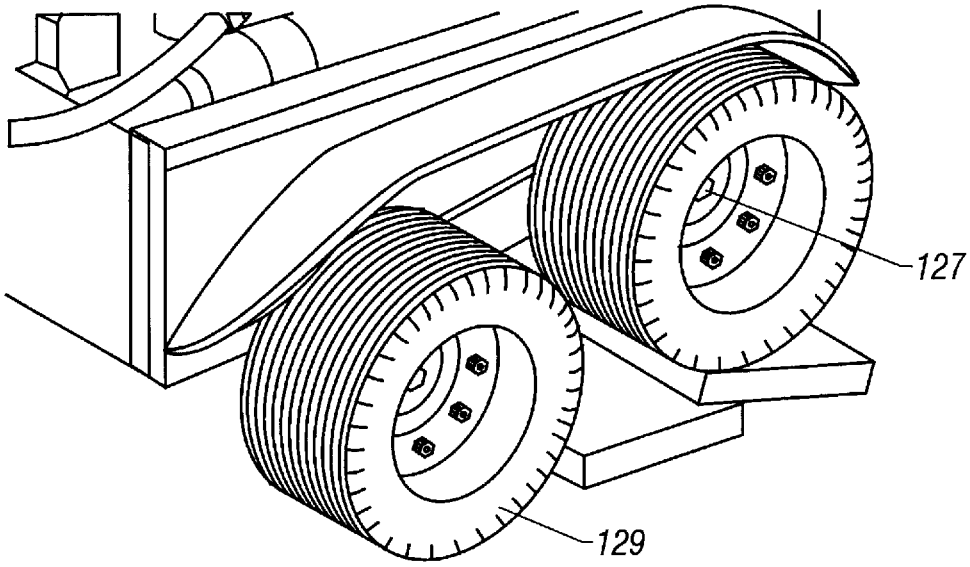
FIG. 16 is an enlarged isometric view of the wheel assembly of the apparatus of FIG. 1 in operation.

A wheel assembly is located at the bottom of lower section 15 for facilitating transportation of apparatus 11. A mounting bracket 121 is secured to each side channel 95 for receiving a center pivot pin 123 extending through a lever 125 on each side of apparatus 11. Thus, each pin 123 allows its respective lever 125 to pivot thereabout (compare FIGS. 15 and 16). A pair of axles 127 extend through and join the ends of levers 125. A non-pneumatic tire and wheel assembly 129 is mounted to the end of each axle 127 for a total of four wheels (two on each side) that work in tandem for improved maneuverability and balance. The additional lever advantage allows the wheels to roll over obstacles much easier than a single axle. Located inside channels 95 adjacent to each of the wheel assemblies are a pair of keyed equipment storage slots 131 (two per side). Each slot 131 can store, for example, one tool extension handle 137 (one shown partially stored in FIG. 11). Thus, apparatus 11 can store up to four tool extension handles 137. Slots 131 are keyed as shown to better retain 137 while apparatus 11 is being moved or transported.

In operation (FIG. 15), apparatus 11 is connected to an electrical power supply (preferably AC) and water tank 115 is filled with water from an external water source. If apparatus 11 is to be used for drywalling, drywall compound is added to mixing compartment 25 and an appropriate amount of water is dispensed from jets 45. Augers 55 are then actuated to pre-mix the compound and water to a desired consistency. More water and/or compound can be added at any time. When the mixed material is ready, pump 103 can be engaged to deliver the mixed material to a desired location.

Figure 13B:
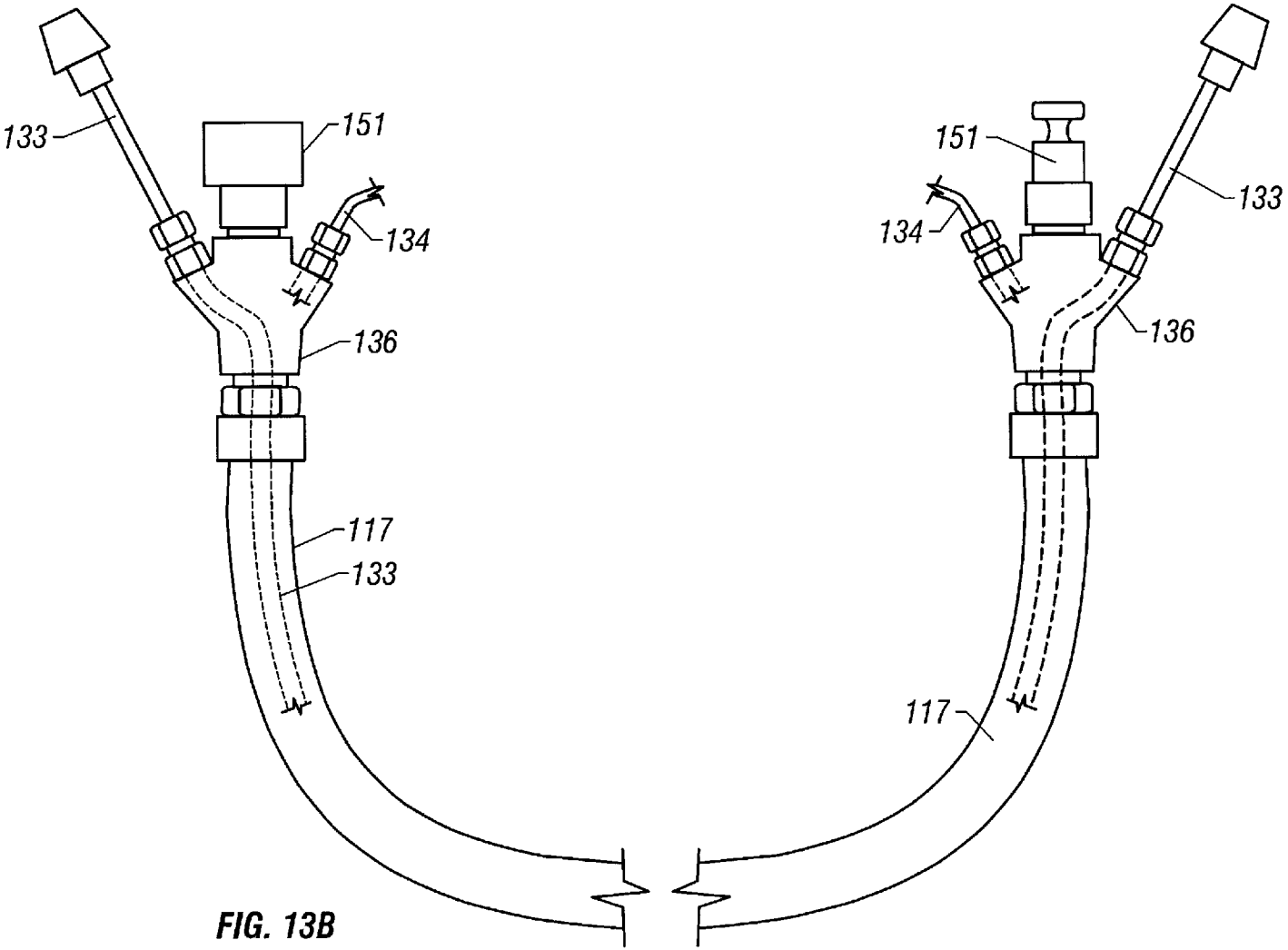
FIG. 13*b* is a partially sectioned view of a hose for the apparatus of FIG. 1.

Apparatus 11 is used as one component of an overall automated interior finishing system and method for completing surface finishes. For example, as shown in FIG. 15, one end of supply hose 117 is connected to the outlet end of pump 103 for automatically and continuously (if desired) delivering mixed material to a hand tool or applicator at the opposite end. Preferably, hose 117 is 50 to 100 feet long and has a diameter of ⅜-inch to ½-inch. Hose 117 is also provided with a unique internal electrical cord 133 for distributing electrical power from apparatus 11 to the applicator or hand tool at the end of hose 117. Electrical cord 133 is a small diameter conduit that extends through the hollow inner diameter of hose 117 to better protect cord 133 and give hose 117 a more streamlined appearance. The material moving inside hose 117 does not affect cord 133, nor does cord 133 substantially affect the flow of material through hose 117. This configuration is illustrated in FIG. 13*b*. Alternatively, a conduit 134 such as pressurized air lines or other types of fluid-conveying tubes may be utilized inside hose 117 in addition to or in place of cord 133. A fitting 136 is used at each end of hose 117 to separate cord 133 and/or conduit 134 from the fluid flow therein.

Hose 117 may be wrapped on a hose reel or hose rack 145 of apparatus 11 (FIG. 13*a*) or extended therefrom (FIG. 15) depending on the length of hose 117 required to reach the area of application. Also shown in FIG. 13*a* is the bottom frame 18 having handles 20, 22 that provide additional pick-up points for apparatus 11. Bottom frame 18 also serves to protect the rotor and stator on pump 103, provides a skid surface on the bottom of apparatus 11, and levels the machine when it is stationary.

In the example shown, hose 117 and cord 133 are interconnected with complementary connectors on a universal control handle (UCH) 135, which will be described in further detail below. UCH 135 is adapted to work in conjunction with many different types of tools, only one of which is shown. UCH 135 is shown attached to a tool extension handle 137. A flat taper 139 is mounted to the distal end of extension handle 137 for making simultaneous, single-pass applications of drywall compound and tape. Flat taper 139 enables hands-free embedding of the tape 143 in the compound as tape 143 is deployed from a tape dispenser 141, which is shown mounted around the waist of the user. Water and compound are loaded and mixed in mixing compartment 25 as previously described.

One skilled in the art will recognize that many other combinations of tools and components are possible for finishing surfaces, depending upon the particular application required. For example, the automated finishing system for interior surfaces also may be used in conjunction with corner tapers, flat knives, box tools, automatic tapers, corner trowels, corner flushers, framed finishers, hawks, pans, texture spray guns, or painting equipment such as rollers or stomp mops. Moreover, any existing prior art tool or component may be readily adapted or modified to work in conjunction with this system or in the manner that it was originally intended to be used.

Each of the tools and accessories, including UCH 135, are preferably formed from stainless steel, titanium, and plastic. The bladed tools are provided with quick and easy blade changes, and have reversible, double-life blades with electroless nickel coatings for improved life. Depending upon the application, identical clamp connections can be made among suitable tools and accessories, and hand tools can be fitted with extension handles when appropriate.

Figure 17:
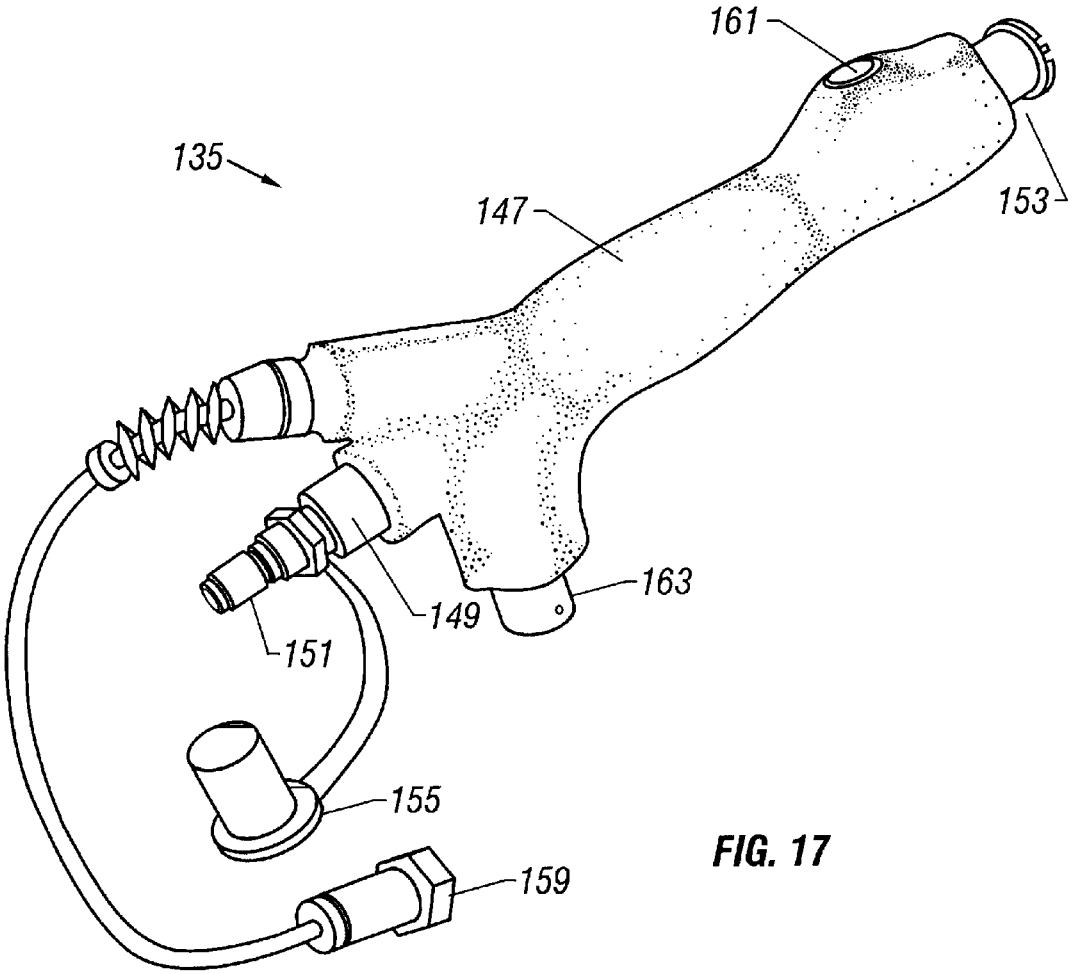
FIG. 17 is an isometric view of a universal control handle utilized during the operation of the apparatus as shown in FIG. 15.
Figure 18:
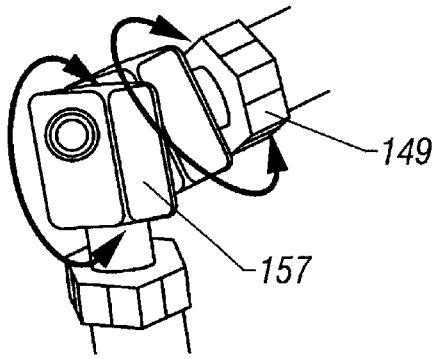
FIG. 18 is an enlarged isometric view of a lower portion of the handle of FIG. 17.

As shown in FIGS. 17 and 18, one version of the universal control handle (UCH) 135 comprises a rigid, ergonomic plastic grip 147 having a material feed port 149 with a quick connect coupling 151 on a proximal end, and a hand tool connection port 153 on a distal end. A line cap 155 is mounted to UCH 135 to seal feed port 149 or coupling 151 when not in use. Otherwise, UCH 135 may be connected to hose 117 (FIG. 15), an extension handle, or to a swivel 157 (FIG. 18) to allow tools to be used in any direction and angle (see arrows), and with minimal strain on the operator. UCH 135 also has an electrical connector 159 for distributing power to an on/off control switch 161 and to a volume control switch 163. Thus, control features for pump 103 are built into UCH 135. The operator can control on/off functions and the volumetric flow rate of compound remotely with UCH 135. All electrical components are sealed and moisture resistant, and operate at low voltage for operator safety.

Figure 19:
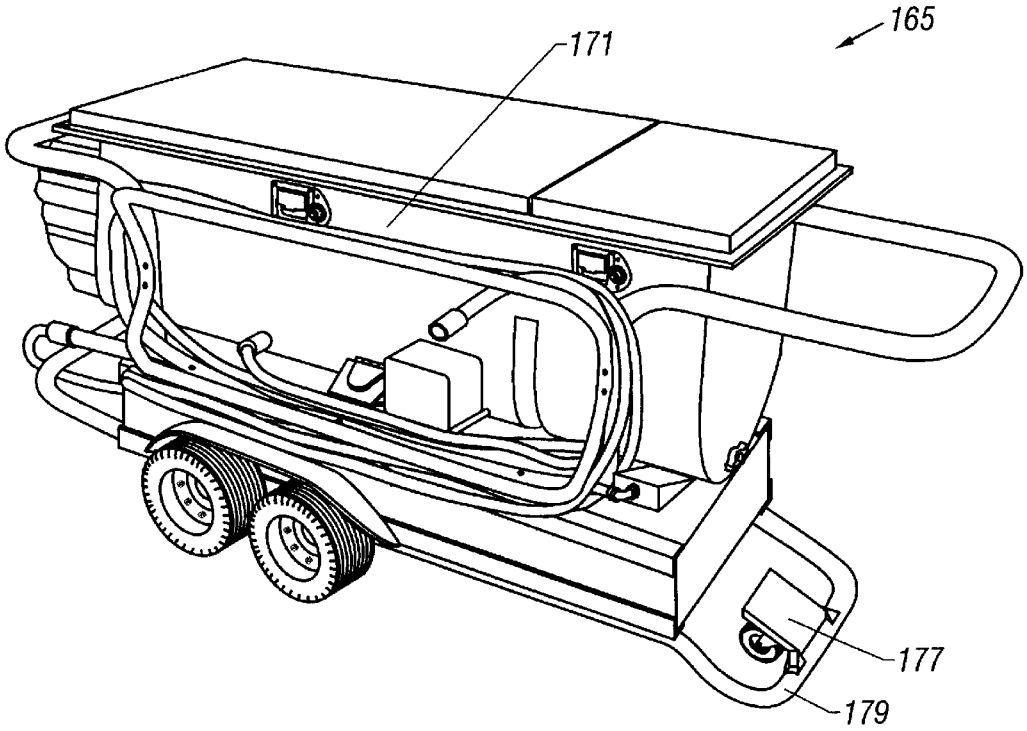
FIG. 19 is an isometric view of a second embodiment of an automated interior finish apparatus constructed in accordance with the invention and having dual pump capability.
Figure 20:
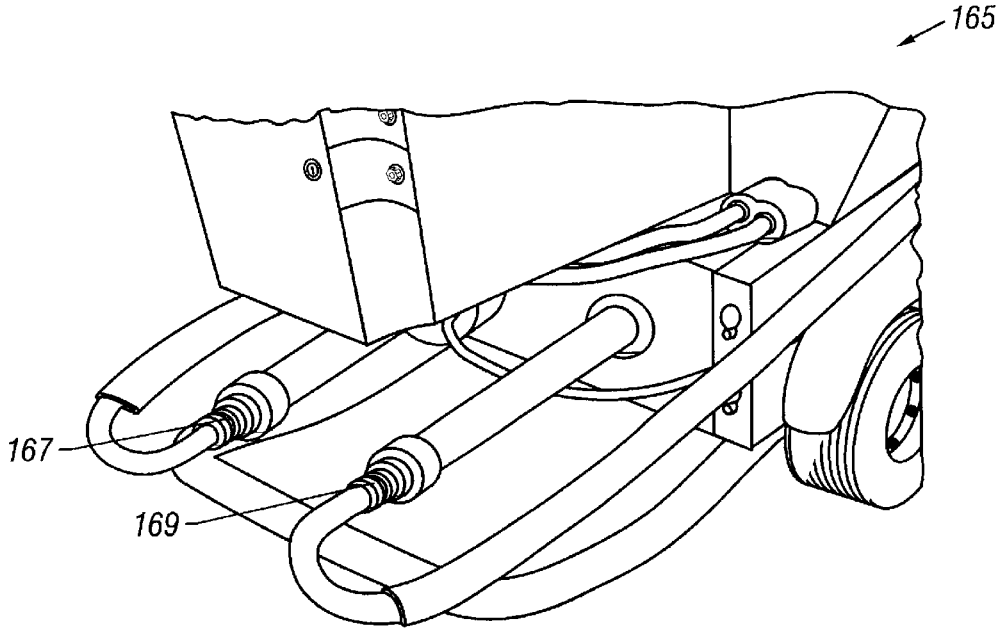
FIG. 20 is an isometric view of an end of a lower portion of the apparatus of FIG. 19.
Figure 21:
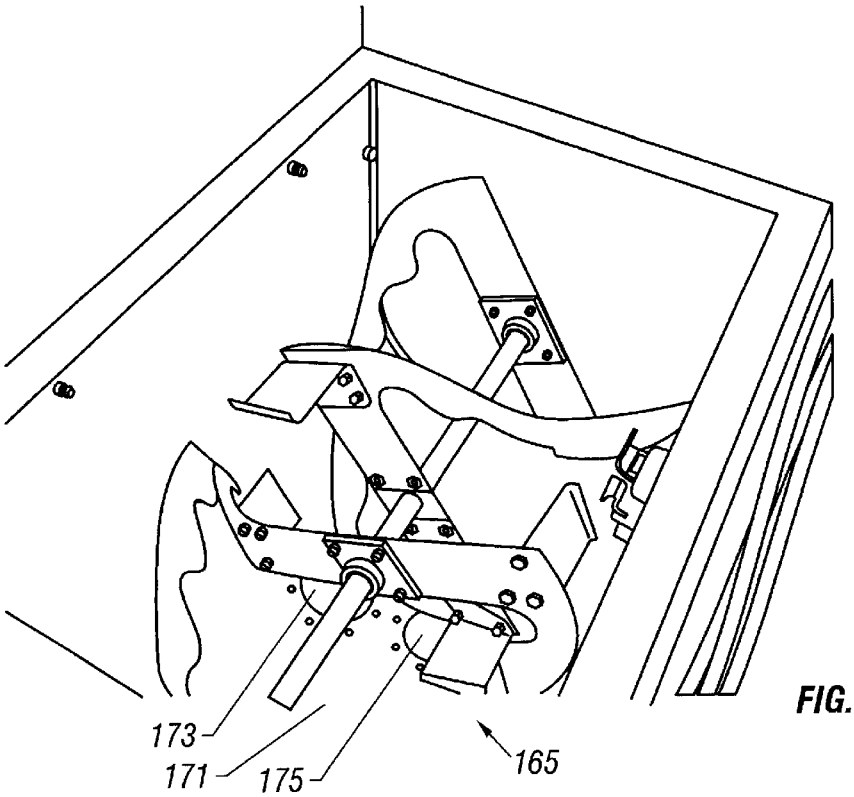
FIG. 21 is an isometric view of an upper portion of the apparatus of FIG. 19 shown with the lids open.

Referring now to FIGS. 19–21, a second embodiment of an automated interior finish apparatus 165 is shown. The primary difference between apparatus 165 and apparatus 11 is that apparatus 165 has two pumping systems 167, 169 that dispense material from an enlarged mixing compartment 171. The dual pumps 167, 169 allow two operators to simultaneously use apparatus 165 with no loss in performance or efficiency over apparatus 11. Mixing compartment 171 is provided with two pump inlets 173, 175 (FIG. 21) to feed the two pumping systems 167, 169, each of which is aligned with force plates as described above. Apparatus 165 and apparatus 11 are otherwise operationally very similar or virtually identical. To facilitate better mobility for apparatus 165 around the job site, a small wheel assembly 177 is provided on one end of the lower portion of frame 179. Wheel assembly 177 may be pivotally relocated into or out of contact with the ground supporting surface.

Figure 22:
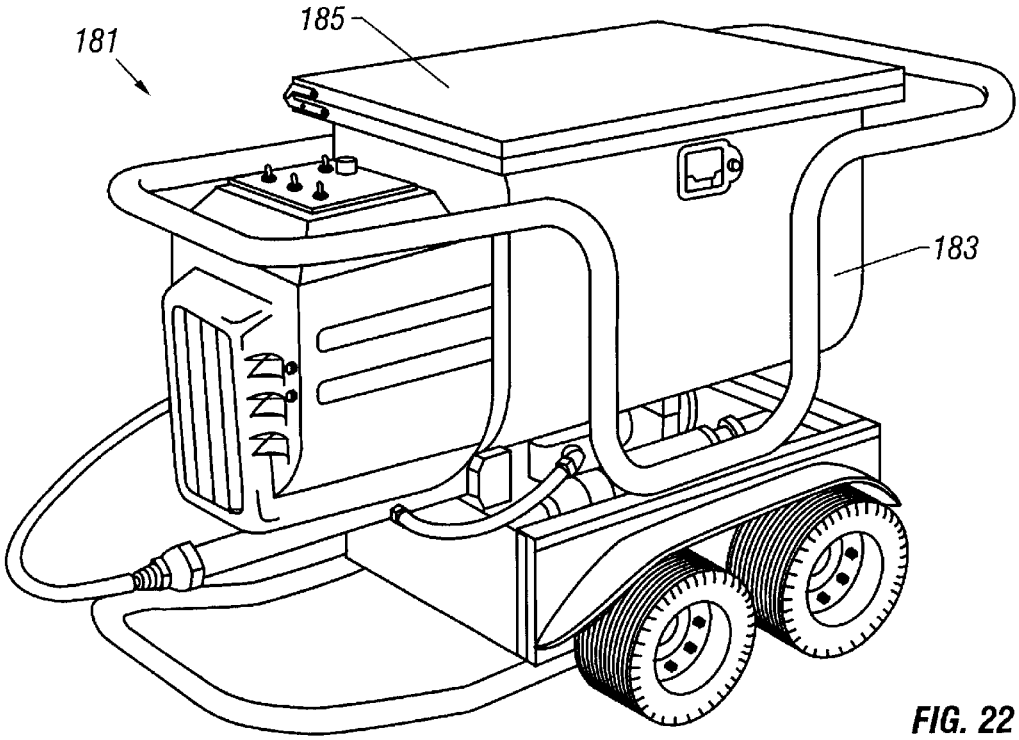
FIG. 22 is an isometric view of a third embodiment of an automated interior finish apparatus constructed in accordance with the invention and having a single compartment.
Figure 23:
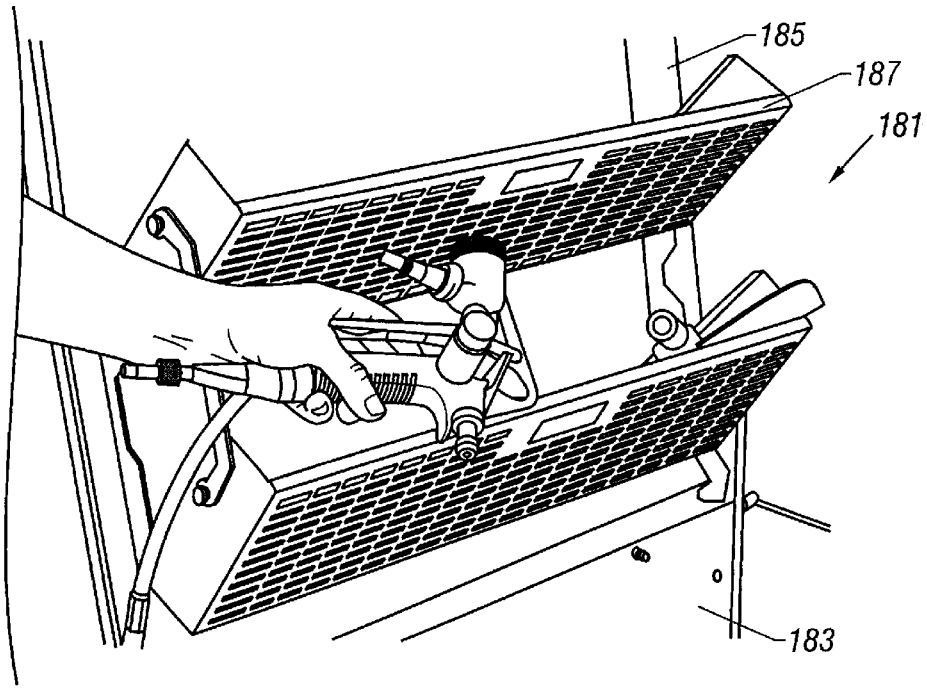
FIG. 23 is an isometric view of an upper portion of the apparatus of FIG. 22 illustrating a storage rack located within the compartment.
Figure 24:
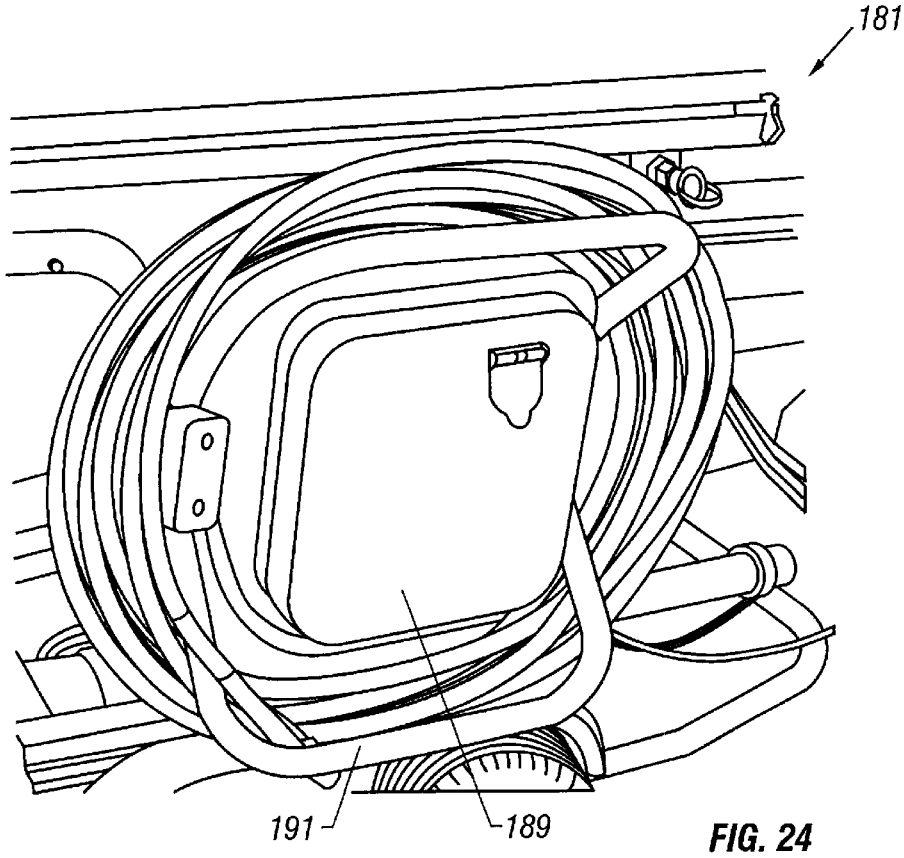
FIG. 24 is an opposite isometric view of the apparatus of FIG. 22.

Referring now to FIGS. 22–24, a third embodiment of an automated interior finish apparatus 181 is shown. The primary difference between apparatus 181 and the previous two apparatus 11, 165 is that apparatus 181 is much smaller with only one compartment 183 for mixing, clean-up, and tool storage. Compartment 183 feeds a single pump and is much smaller and lighter than the previous versions of the invention. The lid 185 for compartment 183 has interior tool storage racks 187 (FIG. 23) that compensate for the lack of a separate storage compartment. There are preferably two folding tool storage racks 187 as shown for supporting tools in compartment 183 when apparatus 181 is not in operation. Because of its small size, apparatus 181 also has an external water tank 189 and hose rack 191 (FIG. 24) located on one side rather than beneath compartment 183.

Figure 25:
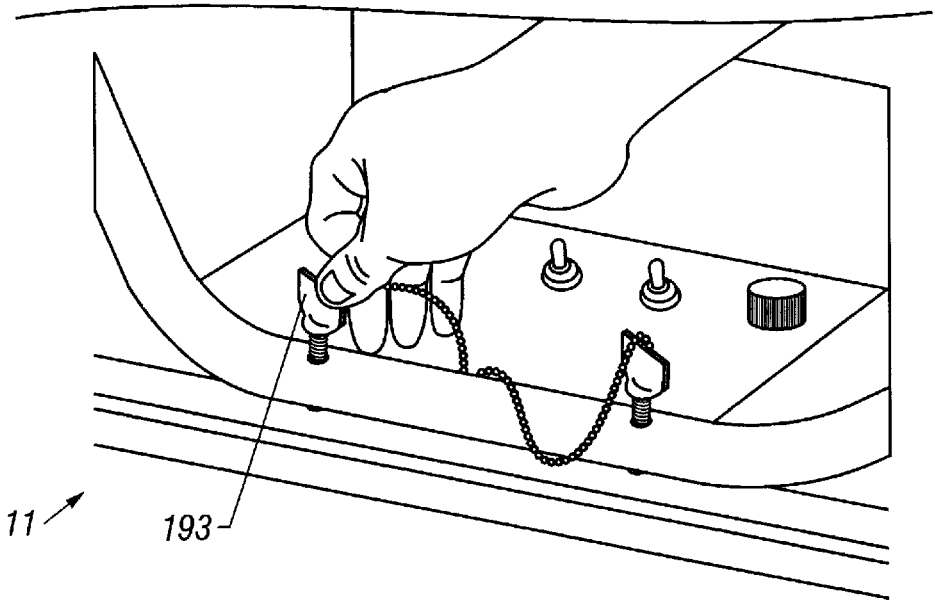
FIG. 25 is an isometric view of the apparatus of FIG. 22 illustrating an initial step of the disassembly thereof.
Figure 26:
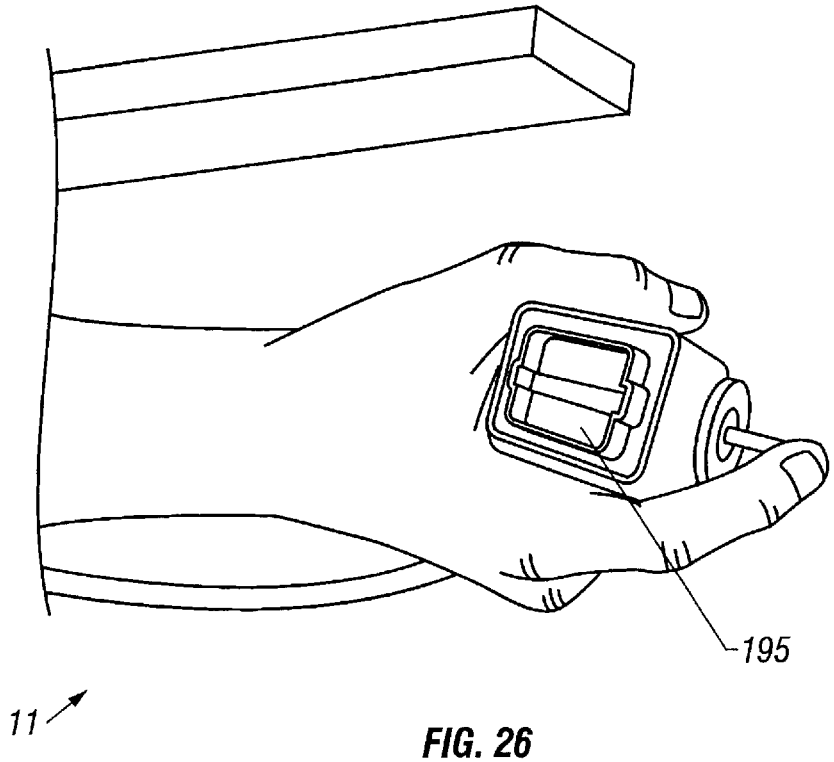
FIG. 26 is an isometric view of the apparatus of FIG. 22 illustrating a second step of the disassembly thereof.
Figure 27:
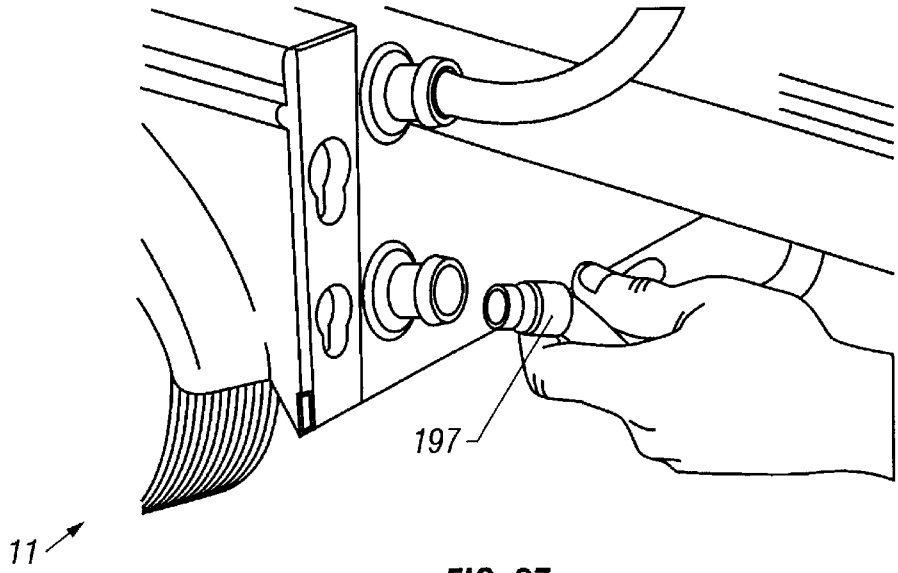
FIG. 27 is an isometric view of the apparatus of FIG. 22 illustrating a third step of the disassembly thereof.
Figure 28:
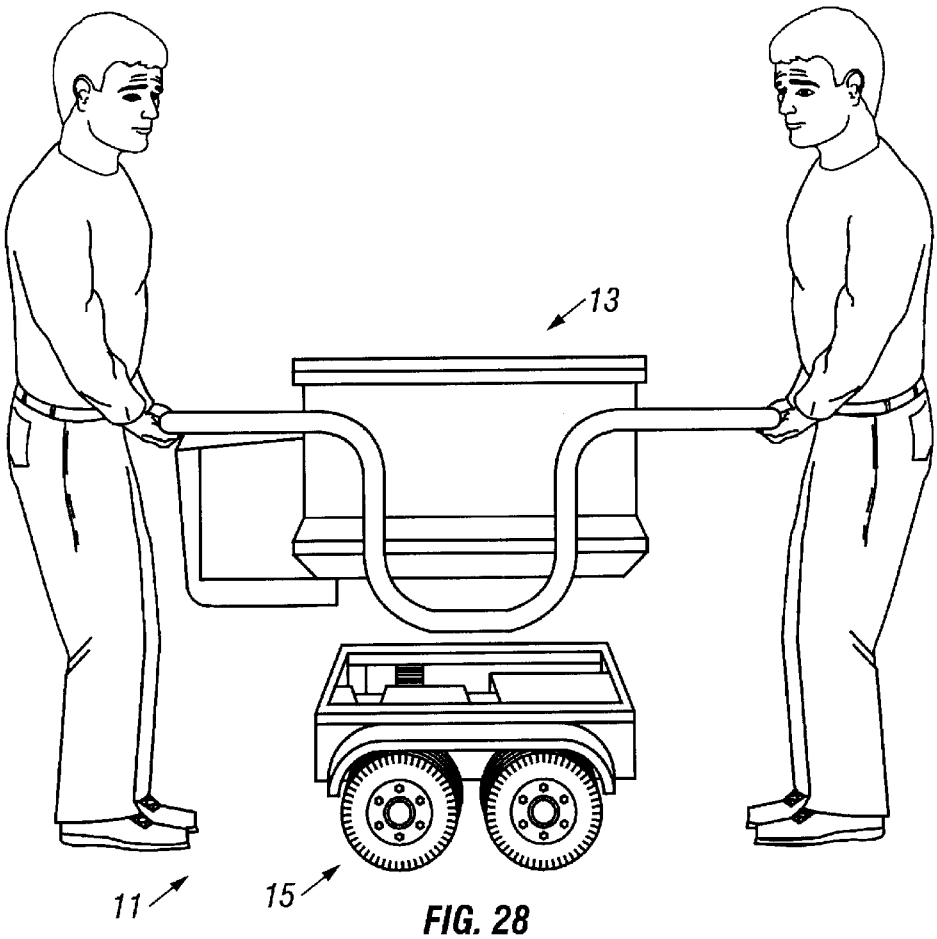
FIG. 28 is an isometric view of the apparatus of FIG. 22 illustrating a final step of the disassembly thereof.

Each of the aforementioned embodiments of the present invention is also capable of being partially disassembled or broken down into two separate, lighter pieces with four easy steps. Ideally, the entire process takes less than two minutes and makes the units much more maneuverable, thereby enabling two people to comfortably transport the entire machine to any area of a job site and then reassemble the unit. It is even possible for one person to load and unload the entire unit onto and off of a truck if necessary. These features make the present invention very accessible for maintenance purposes, allowing ready access to the undercarriage. As shown in FIGS. 26 and 27, the first two steps are to unplug the electrical connections 195 and the water connections 197 that extend between, for example, the upper section 13 of apparatus 11 and its lower section 15. The third step is to unscrew the four wing nuts 193 (FIG. 25) that fasten upper and lower sections 13, 15 together. In the final step, upper section 13 is unlatched and lifted off of lower section 15 to complete the separation of apparatus 11 into two more easily movable pieces. The same steps may be followed for breaking down apparatus 165 and 181.

An added benefit of separating the upper and lower sections is the ability to interchange different upper and lower sections. Moreover, the upper sections can stand alone as a completely independent job site mixer, even without the lower section. This allows the lower section to be added later for full automation. Different variations of tank designs can be specified and added to the lower section very easily. The split design allows easy and quick access to all the components located in the lower section, and greatly enhances the ease of maintenance.

The present invention has many advantages as the first truly automated machine for drywall finishing. All drywall and interior applications can be completed with the invention from start to finish. This automated interior finish system tremendously increases efficiency over prior art systems and methods. The present invention not only supplies compound directly to the finishing tools, but it also reduces the physical movements required to finish drywall. The smooth flow of the joint compound to the tools also improves the quality of the work on the walls and ceiling with less floor splatter.

The mud pump is designed to eliminate jamming when dry compound is added to the mixing tank. The unmixed compound is forced to mix with water and residual mixed compound via a unique helical rotor or agitator located adjacent to the pump inlet. Thus, the present invention minimizes the formation of chunks of dried compound. Moreover, the joint compound remains in a sealed tank and is not exposed to ambient air which would otherwise dry the compound before it is applied to the wall. Compounds which remain the air-tight chamber after use stay moist, thereby eliminating the need for clean-up on a daily basis. Additionally, the mixing auger and pump uniformly mix the material for ultimate consistency. The result is a substantial increase in efficiency over the most advanced systems currently available.

A positive displacement pump with a variable speed drive ensures a smooth and uniform supply of material through the supply hose. The modified ribbon mixer or auger keeps drywall, acoustic, or paint compounds at a uniform consistency. Material is delivered to the tools in a smooth, regulated flow. An on-board water system provides the ability to add water and reduce material viscosity. Hose-to-tank connection provides simultaneous compound mixing and circulation. The water sprayer is pressurized and has fingertip control to provide on-board clean-up. The water reservoir is conveniently located and has an easy-access, non-detachable cover. The external hose rack provides a neat and efficient method of storage for the small diameter hose.

The machine if constructed from high quality stainless steel to eliminate corrosion and increase durability. Simple, easy-to-understand controls are conveniently located on a centralized panel. All electrical components are moisture-sealed in a safe, non-conductive, durable cover. External, sealed, water-tight, resettable fuses also add safety and convenience. The machine and console are protected by a tough one-inch, schedule-40 stainless steel pipe frame. A pair of pivotally-mounted tandem wheels provide excellent jobsite maneuverability and balance for the machine. The unit easily pulls along behind the operator on non-pneumatic tires that cannot flatten.

The machine is also provided with extension handles that store neatly in four storage compartments for providing additional pick-up points and flexible jobsite handling. In addition, all components can be stored on or in the machine in convenient locations. For example, hand tools are conveniently stored on two folding storage racks located in the mixing tank lid. The air tight seals prevent compound from setting in the tools, thereby eliminating the need for clean-up between intermittent use.

The larger units of the present invention have additional air-tight tanks for extra storage and clean-up. A locking latch on the exterior of the tank permits controlled access for tool protection. The mixing chamber is electrically interlocked for operator safety. Finally, the present invention may be broken down into a more manageable size in less than two minutes.

Another feature of the present invention is that it is readily adaptable to work in conjunction with prior art traditional or standard tools such as box tools, tubular mud wipe down units, hawks, and pans. Such adaptation increases the speed and efficiency of application, while allowing prior art tools to retain their manual usability. A continual feed of mixed material is sent to standard tools for uninterrupted application so that they never have to be refilled. The mud reservoir on the box tool fills during the time the tool is taken away from the wall and moved to another joint. This system allows the box to apply mud potentially faster than the pump can deliver, thereby allowing the pump to run at a more continuous speed.

While the invention has been shown or described in only some of its forms, it should be apparent to those skilled in the art that it is not so limited, but is susceptible to various changes without departing from the scope of the invention.

What is claimed is:

1. An apparatus for applying a material to a wall surface, comprising:

a structural support frame;

a compartment mounted to the frame, having a lower partially cylindrical portion with a compartment outlet;

a power mixer that includes a helical auger for mixing material in the compartment;

a pump in communication with the compartment outlet for pumping material from the compartment;

a flexible conduit leading from the pump for dispensing the material to an applicator; wherein:

the helical auger has an axial shaft and a helical blade mounted thereto that has an outer periphery that defines a cylindrical surface of revolution passing in close proximity to the cylindrical portion of the compartment while the auger is rotated; and a force plate is carried by the shaft, the plate being aligned with the outlet and at an angle that is skewed to the cylindrical surface of the compartment in order that when the blade is rotated in a forward direction a leading edge of the force plate is farther from the cylindrical surface of the compartment than a trailing edge of the force plate, causing material within the compartment to be forced into the outlet.

2. The apparatus according to claim 1, wherein the leading edge of the force plate while the pump is operating in the forward direction has a greater width than the trailing edge while the pump is operating in the forward direction.

3. An apparatus for applying a material to a wall surface, comprising:

a structural support frame;

a compartment mounted to the frame, having a lower partially cylindrical portion with a compartment outlet;

a power mixer that includes a helical auger for mixing material in the compartment;

a pump in communication with the compartment outlet for pumping material from the compartment;

a flexible conduit leading from the pump for dispensing the material to an applicator; and an electrical controller that controls the power mixer and the pump, the controller having a mode that prevents the pump from operating unless the auger is rotating in a forward direction.

4. The apparatus according to claim 3, wherein the helical auger has an axial shaft and a blade mounted to and spaced radially outward and separated from the shaft, the blade having an outer periphery that defines a cylindrical surface of revolution passing in close proximity to the cylindrical portion of the compartment while the auger is rotated.

5. An apparatus for applying a material to a wall surface, comprising:

a structural support frame;

a compartment mounted to the frame, having a lower partially cylindrical portion with a compartment outlet;

a power mixer that includes a helical auger for mixing material in the compartment;

a pump in communication with the compartment outlet for pumping material from the compartment;

a flexible conduit leading from the pump for dispensing the material to an applicator; and an electrical controller that controls the power mixer and the pump, the controller having a mixing mode in which the power mixer rotates the auger in a reverse direction while the pump is not pumping, and a dispensing mode in which the power mixer rotates the auger in a forward direction while the pump is pumping.

6. An apparatus for applying a material to a wall surface, comprising:

a structural support frame;

a compartment mounted to the frame, having a lower partially cylindrical portion having first and second ends and a compartment outlet located intermediate the ends;

a power mixer that includes a helical auger for mixing material in the compartment, the helical auger having an axial shaft extending between the first and second ends of the compartment, a first helical blade extending from the first end to the proximity of the compartment outlet and a second helical blade extending from the second end to the proximity of the compartment outlet, the blades being configured to move the material away from the ends and toward the compartment outlet while being rotated in a forward direction;

a pump in communication with the compartment outlet; and a flexible conduit extending from the pump to an applicator for delivering material pumped by the pump to the applicator.

7. The apparatus according to claim 6, wherein each of the blades is spaced radially outward and separated from the shaft, each of the blades having an outer periphery that defines a cylindrical surface of revolution passing in close proximity to the lower cylindrical portion while the auger is rotated, and each of the blades having an inner periphery with an undulated configuration.

8. The apparatus according to claim 6, further comprising:

a force plate carried by the shaft adjacent an outer periphery of the blade, the plate being aligned with the outlet and at an angle that is skewed to the cylindrical surface of the compartment in order that when the blade is rotated in the forward direction a leading edge of the force plate is further from the cylindrical surface of the compartment than a trailing edge of the force plate, causing material within the compartment to be forced into the outlet.

9. The apparatus according to claim 8, wherein the leading edge of the force plate when the blade is rotated in the forward direction has a greater width than the trailing edge of the plate; and wherein the apparatus further comprises:

a lip extending from a side edge of the force plate in a direction radially outward from the shaft.

10. The apparatus according to claim 6, further comprising an electrical controller that controls the power mixer and the pump, the controller having a mode that prevents the pump from operating unless the power mixer is rotating the auger in the forward direction.

11. The apparatus according to claim 6, further comprising an electrical controller that controls the power mixer and the pump, the controller having a mixing mode in which the power mixer rotates the auger in the reverse direction while the pump is not pumping, and a dispensing mode in which the power mixer rotates the auger in the forward direction.

12. The apparatus according to claim 6, wherein the pump comprises a progressive cavity pump that is driven by a drive shaft, the pump having a helical actuator mounted to the drive shaft for rotation therewith and located at an inlet of the pump for reducing jamming and providing positive delivery of material.

13. The apparatus according to claim 6, further comprising an electrical controller that controls the power mixer and the pump, the controller having an intermittent selection in which the auger ceases to rotate in the forward direction when the pump stops pumping and a continuous selection in which the auger rotates continuously in the forward direction regardless of whether the pump is pumping.

14. An apparatus for applying a material to a wall surface, comprising:

a structural support frame;

a compartment mounted to the frame and having a compartment outlet;

a power mixer including a rotatably driven mixing blade for mixing material in the compartment;

a pump in communication with the compartment outlet for pumping material from the compartment to a pump outlet that is adapted to provide a flow of material to an applicator;

a flexible conduit extending from the pump outlet for connection to the applicator; and an electrical controller connected with the pump and the power mixer, the controller having a mixing mode in which the power mixer rotates the mixing blade in a reverse direction and simultaneously prevents the pump from operating and having a dispensing mode in which the power mixer rotates the mixing blade in a forward direction while the pump operates and simultaneously prevents operation of the pump while the mixing blade is not rotating in the forward direction.

15. The apparatus according to claim 14, wherein the mixing blade is a helical auger.

16. The apparatus according to claim 14, wherein the power mixer has an axial shaft, the blade being spaced radially outward and separated from the shaft, the blade having an outer periphery that defines a cylindrical surface of revolution while the auger is rotated, the blade having an inner periphery with an undulated configuration.

17. The apparatus according to claim 16, further comprising:

a force plate carried by the shaft, the plate being aligned with the outlet and at an angle that is skewed to the cylindrical surface of the compartment in order that when the blade is rotated in the forward direction a leading edge of the force plate is further from the cylindrical surface of the compartment than a trailing edge of the force plate, causing material within the compartment to be forced into the outlet.

18. The apparatus according to claim 17, wherein the leading edge of the force plate while the blade is rotated in the forward direction has a greater width than the trailing edge of the force plate while the blade is rotated in the forward direction; and wherein the apparatus further comprises:

a lip extending from a side edge of the force plate in a radial outward direction relative to the shaft.

19. The apparatus according to claim 14, wherein the dispensing mode has a continuous selection wherein the controller causes the blade to rotate in the forward direction continuously regardless of whether the pump is operating, and an intermittent selection wherein the controller causes the blade to rotate in the forward direction only when the pump is operating.

20. The apparatus according to claim 14, wherein the controller has a mode that prevents the pump from operating unless the auger is rotating in a forward direction.

21. The apparatus according to claim 14, wherein the controller having a mixing mode in which the power mixer rotates the auger in a reverse direction while the pump is not pumping, and a dispensing mode in which the power mixer rotates the auger in a forward direction while the pump is pumping.

22. An apparatus for applying a material to a wall surface, comprising:

a structural support frame;

a compartment mounted to the frame, having a lower partially cylindrical portion with an compartment outlet;

a power mixer that includes a helical auger for mixing material in the compartment; and a pump in communication with the compartment outlet for pumping material from the compartment to an applicator;

a flexible conduit connected to the pump for delivering the material from the pump to the applicator;

a pair of longitudinally extending support members, each of the support members being pivotally mounted to opposite sides of the frame at a pivot point; and a set of tandem wheels mounted to each of the support members, with an axle for one of the tandem wheels on each side of the frame being mounted rearward of the pivot point and an axle for the other of the tandem wheels on each side of the frame being mounted forward of the pivot point; and wherein:

the compartment has two ends with a handle extending from each of the ends; and the apparatus further comprises:

quick-release elements extending between the compartment and the frame for readily detaching the compartment from the frame for handling.

23. The apparatus of claim 22, wherein the compartment has two ends, and the apparatus further comprises:

a brace extending along each side of the compartment.

24. A method of mixing and applying a material to a wall surface, comprising:

(a) providing a compartment with a rotatably driven mixing blade, a compartment outlet in the compartment, and a pump mounted in communication with the compartment outlet and connected to an applicator by a flexible conduit;

(b) placing a wall finish material in the compartment and rotating the blade in a reverse direction to mix the material and simultaneously preventing the pump from pumping the material; then (c) once the material is properly mixed, rotating the mixing blade in a forward direction and causing the pump to pump the material to the applicator which applies the material to a wall surface.

25. The method according to claim 24, wherein the blade of step (a) comprises an auger.

26. The method according to claim 24, further comprising preventing the pump from operating if the blade ceases to rotate in the forward direction.

27. The method according to claim 24, wherein:

step (a) comprises providing the compartment with two ends and positioning the compartment outlet between the ends;

step (b) comprises forcing the material to flow from a vicinity of the outlet toward the ends of the compartment; and step (c) comprises forcing the material to move from the ends of the compartment toward the outlet.

28. The method according to claim 24, wherein step (c) comprises mounting a force plate to the blade for rotation therewith, and rotating the force plate close to and over the compartment outlet as the blade rotates in the forward direction to push the material from the compartment through the compartment outlet.

29. The method according to claim 24, further comprising in step (c) stopping the blade from rotating in the forward direction when the pump stops.

30. The method according to claim 24, further comprising in step (c) continuing to rotate the blade in the forward direction even though the pump stops pumping.

31. The method according to claim 24, wherein step (b) comprises mounting a force plate to the blade for rotation therewith, and rotating the force plate close to and over the compartment outlet as the blade rotates in the reverse direction to draw the material away from the compartment outlet.

32. An apparatus for applying a material to a wall surface, comprising:

a structural support frame;

a compartment mounted to the frame, having a lower partially cylindrical portion with a compartment outlet;

a power mixer that includes a helical auger for mixing material in the compartment;

a pump in communication with the compartment outlet for pumping material from the compartment;

a flexible conduit leading from the pump for dispensing the material to an applicator; and wherein the helical auger has an axial shaft and a blade mounted to and spaced radially outward and separated from the shaft, the blade having an outer periphery that defines a cylindrical surface of revolution passing in close proximity to the cylindrical portion of the compartment while the auger is rotated, the blade having an inner periphery with an undulated configuration.

33. An apparatus for applying a material to a wall surface, comprising:

a structural support frame;

a compartment mounted to the frame, having a lower partially cylindrical portion with a compartment outlet;

a power mixer that includes a helical auger for mixing material in the compartment;

a pump in communication with the compartment outlet for pumping material from the compartment;

a flexible conduit leading from the pump for dispensing the material to an applicator;

a shaft that supports the helical auger;

a force plate carried by the shaft, the plate being aligned with the outlet and at an angle that is skewed to the cylindrical surface of the compartment in order that when the blade is rotated in a forward direction, a leading edge of the force plate is farther from the cylindrical surface of the compartment than a trailing edge of the force plate, causing material within the compartment to be forced into the outlet, and when the blade is rotated in a reverse direction, the leading edge of the force plate is closer to the cylindrical surface of the compartment than the trailing edge of the force plate, causing material to be forced away from the compartment outlet; and a lip extending radially outward from a side edge of the force plate.

34. An apparatus for applying a material to a wall surface, comprising:

a structural support frame;

a compartment mounted to the frame, having a lower partially cylindrical portion with a compartment outlet;

a power mixer that includes a helical auger for mixing material in the compartment;

a pump in communication with the compartment outlet for pumping material from the compartment; and an electrical controller that controls the power mixer and the pump, the controller having an intermittent selection in which the auger rotates in a forward direction only when the pump is pumping.

35. An apparatus for applying a material to a wall surface, comprising:

a structural support frame;

a compartment mounted to the frame, having a lower partially cylindrical portion with a compartment outlet;

a power mixer that includes a helical auger for mixing material in the compartment;

a pump in communication with the compartment outlet for pumping material from the compartment; and an electrical controller that controls the power mixer and the pump, the controller having a continuous selection in which the auger rotates continuously in a forward direction regardless of whether the pump is pumping.

* * * * *